US009339133B2

(12) United States Patent
Zox

(10) Patent No.: US 9,339,133 B2
(45) Date of Patent: May 17, 2016

(54) COCKTAIL PLATE

(71) Applicant: John Zox, New York, NY (US)

(72) Inventor: John Zox, New York, NY (US)

(73) Assignee: Holdaplate, LLC, New York, NY (US)

( * ) Notice: Subject to any disclaimer, the term of this patent is extended or adjusted under 35 U.S.C. 154(b) by 76 days.

(21) Appl. No.: 14/255,766

(22) Filed: Apr. 17, 2014

(65) Prior Publication Data

US 2014/0284340 A1 Sep. 25, 2014

Related U.S. Application Data

(63) Continuation of application No. 13/706,156, filed on Dec. 5, 2012, now Pat. No. 8,714,399, which is a continuation of application No. 13/460,251, filed on Apr. 30, 2012, now Pat. No. 8,348,091.

(51) Int. Cl.

| | |
|---|---|
| ***B65D 6/04*** | (2006.01) |
| ***A47G 19/00*** | (2006.01) |
| ***A47G 19/02*** | (2006.01) |
| ***A47G 19/06*** | (2006.01) |

(52) U.S. Cl.

CPC ..... *A47G 19/06* (2013.01); *A47G 19/065* (2013.01)

(58) Field of Classification Search

USPC ..... 220/23.6, 23.8, 574, 574.1, 575, 694, 220/703, 710.5, 737, 738; 206/503, 510, 206/564

See application file for complete search history.

(56) References Cited

U.S. PATENT DOCUMENTS

| | | | |
|---|---|---|---|
| 757,645 | A | 4/1904 | Bassett |
| 1,272,996 | A | 7/1918 | Poschadel |
| D135,524 | S | 4/1943 | Johnstone |
| 2,427,697 | A | 9/1947 | Weidler |
| D154,671 | S | 8/1949 | Foley |
| 2,582,183 | A | 1/1952 | Weidler |
| D170,735 | S | 10/1953 | Zeisel |
| 2,664,722 | A | 1/1954 | Barr |
| D197,245 | S | 12/1963 | Bateson |
| 3,401,858 | A | 9/1968 | White et al. |
| 3,955,672 | A | 5/1976 | Brundage |
| D270,324 | S | 8/1983 | French |
| 4,607,758 | A | 8/1986 | Stevens |
| 4,744,597 | A | 5/1988 | Bauman et al. |
| D307,529 | S | 5/1990 | Baetens |
| 4,966,297 | A | 10/1990 | Doty |
| 5,060,820 | A | 10/1991 | Boerner |

(Continued)

FOREIGN PATENT DOCUMENTS

WO 2007/001047 1/2007

OTHER PUBLICATIONS

Wavetrends Clear Plastic Cocktail Plate with Stemware Hole, available at www.webstaurantstore.com/wavetrends-clear-plastic-cocktail-plate-with-stemware-hole-6-x-9-1-2-120-cs/3461409CL.html dated Jul. 7, 2011.

*Primary Examiner* — Fenn Mathew
*Assistant Examiner* — Madison L Poos
(74) *Attorney, Agent, or Firm* — Edward J. Baba; Bozicevic, Field & Francis LLP

(57) ABSTRACT

Provided are plate designs that enable a user to hold a plate in one hand, together with a drinking cup in the same hand. The subject designs find use in various situations in which a user desires to hold a plate and a drinking cup simultaneously. The subject designs also find use in various situations in which a user desires to hold a plate securely, in the presence or absence of a drinking cup.

20 Claims, 24 Drawing Sheets

(56) References Cited

U.S. PATENT DOCUMENTS

| | | | |
|---|---|---|---|
| 5,085,391 | A | 2/1992 | Berger et al. |
| 5,119,967 | A | 6/1992 | Ercolani |
| 5,294,000 | A | 3/1994 | Yanuzzi |
| 5,346,070 | A | 9/1994 | McSpadden |
| D352,367 | S | 11/1994 | Gryzlak |
| D359,885 | S | 7/1995 | Yanuzzi |
| 5,542,577 | A | 8/1996 | Friedrich |
| D373,933 | S | 9/1996 | Gibbs, III |
| 5,551,593 | A | 9/1996 | Wiens |
| 5,662,240 | A | 9/1997 | Norris |
| D384,556 | S | 10/1997 | Logan et al. |
| D388,661 | S | 1/1998 | Vignau et al. |
| D402,509 | S | 12/1998 | Indekeu |
| 5,947,011 | A | 9/1999 | Xu |
| D415,930 | S | 11/1999 | Schmidt |
| 6,021,914 | A | 2/2000 | Schmidt |
| D430,458 | S | 9/2000 | Kellermann |
| D455,050 | S | 4/2002 | Tyler et al. |
| D472,768 | S | 4/2003 | Wellner |
| D473,757 | S | 4/2003 | Schwartz |
| 6,609,325 | B2 | 8/2003 | Harris |
| 6,609,625 | B1 | 8/2003 | Gibbar |
| 6,691,890 | B1 | 2/2004 | Persson |
| 6,702,141 | B1 | 3/2004 | Cinque |
| 7,000,799 | B1 | 2/2006 | Hamre |
| D519,323 | S | 4/2006 | Warner |
| D537,679 | S | 3/2007 | Majka |
| D559,615 | S | 1/2008 | Laib |
| D588,879 | S | 3/2009 | Brett |
| D589,753 | S | 4/2009 | Williams |
| D589,754 | S | 4/2009 | Williams |
| D592,458 | S | 5/2009 | Scherer |
| D594,281 | S | 6/2009 | Luft |
| D594,705 | S | 6/2009 | McComas |
| D595,093 | S | 6/2009 | McComas |
| 7,543,869 | B2 | 6/2009 | Davis |
| D626,788 | S | 11/2010 | Clark |
| D632,527 | S | 2/2011 | Olivari et al. |
| D645,310 | S | 9/2011 | Shamoon |
| D650,237 | S | 12/2011 | McComas |
| D653,085 | S | 1/2012 | Swallow |
| 8,136,667 | B2 | 3/2012 | Raynor |
| D668,508 | S | 10/2012 | Zox |
| D673,007 | S | 12/2012 | Zox |
| 2004/0099670 | A1 | 5/2004 | Michaeli |
| 2005/0115974 | A1 | 6/2005 | Micciulla |
| 2005/0161453 | A1 | 7/2005 | Corrieri |
| 2006/0266748 | A1 | 11/2006 | Crawford |
| 2009/0152157 | A1 | 6/2009 | Schaaper et al. |
| 2012/0000915 | A1 | 1/2012 | Swallow |

COCKTAIL PLATE

BACKGROUND

In certain social situations, such as cocktail parties, barbecues, picnics, family reunions and the like, a guest may be furnished with food and beverage to be consumed in the course of interacting with other guests. When furnished with food and beverage at or around the same time, a drinking cup containing the beverage is often carried in one hand, and a food carrying receptacle, such as a plate, is often carried in the other hand. Securely holding the plate enables one to consume the food without spilling. Securely holding a plate may become increasingly difficult when the guest is also holding a drinking cup. The guest may need to place one or both of the items on a surface, if one is available, in order to interact with other guests or consume the food. Actions such as shaking hands, exchanging business cards, and the like thus may be difficult if a guest is holding both a plate and a drinking cup, particularly if no convenient resting surface is available upon which to place the plate or drinking cup. Attempting to hold a plate and a drinking cup in just one hand increases the risk of spillage of the food and/or beverage onto the guest, other guests, or on the surrounding area.

SUMMARY

The present invention provides a plate that a user may hold in one hand, along with a drinking cup held in the same hand. Several instances of the plate are provided herein. A common feature of these instances is that the drinking cup is not attached to the plate, and does not rest on the plate or in an opening through the plate. Rather, the plate may provide one or more incurvate portions which may facilitate holding a drinking cup and the plate simultaneously using the same hand. The subject designs may find use in various scenarios in which a user desires to hold a plate and a drinking cup simultaneously. The subject designs also may find use in various scenarios in which a user desires to hold a plate securely, in the presence or absence of a drinking cup.

In certain instances, a plate may include a base having a periphery; the periphery including an incurvate portion and left and right immediately adjacent portions; the incurvate portion having left and right parts; the left part of the incurvate portion being immediately adjacent to the left immediately adjacent portion of the periphery; the right part of the incurvate portion being immediately adjacent to the right immediately adjacent portion of the periphery; the incurvate portion corresponding generally with an arc that extends no more than about 180° from the left immediately adjacent portion to the right immediately adjacent portion; at least one of the left and right parts having a raised edge; the raised edge including an inside surface facing a central food-receiving surface of the base; the raised edge having an outside surface facing away from the central food-receiving surface of the base; the raised edge being elevated in relation to a respective edge of at least one of the left and right immediately adjacent portions that is immediately adjacent to the raised edge; where the incurvate portion is structured and dimensioned so that the plate may be held in one hand of a user together with a drinking cup, with the user's finger fitting over one of the immediately adjacent portions and along the inside surface of the adjacent raised edge of the incurvate portion, and with the raised edge and the drinking cup being pressed against each other along the outside surface of the adjacent raised edge. In certain aspects, both the left and right parts of the incurvate portion may have a raised edge. In other aspects, only one of the left and right parts has a raised edge (e.g., the left part has a raised edge and the right part does not, or vice versa).

In another aspect, a plate may include a base having a periphery; the periphery including an incurvate portion and left and right immediately adjacent portions; the incurvate portion having left and right parts; the left part of the incurvate portion being immediately adjacent to the left immediately adjacent portion of the periphery; the right part of the incurvate portion being immediately adjacent to the right immediately adjacent portion of the periphery; at least one of the left and right parts having a raised edge; the raised edge having an inside surface facing a central food-receiving surface of the base; the raised edge including an outside surface facing away from the central food-receiving surface of the base; at least one of the left and right immediately adjacent portions that is immediately adjacent to the raised edge including a movable part that is structured and dimensioned to pushed open to create a finger slot; wherein the incurvate portion is structured and dimensioned so that the plate may be held in one hand of a user together with a drinking cup, with the user's finger fitting through the finger slot of one of the immediately adjacent portions and along the inside surface of the adjacent raised edge of the incurvate portion, and with the raised edge and the drinking cup being pressed against each other along the outside surface of the adjacent raised edge.

In another aspect, a plate may include a food-receiving surface and a periphery; the food-receiving surface having a top side and a bottom side, wherein food, when placed, is on the top side; the periphery including an incurvate portion including an inner side, an outer side, and a groove; the incurvate portion corresponding generally with an arc that extends no more than about 180°; the inner side being immediately adjacent to the food-receiving surface and including a raised edge separating the food-receiving surface from the outer side, the raised edge having a first surface and a second surface, wherein the first surface is adjacent to the food receiving surface; the outer side including a raised edge having a first surface and a second surface, wherein the first surface of the outer side is opposite the second surface of the inner side; the groove being formed between the second surface of the raised edge of the inner side and the first surface of the raised edge of the outer side; wherein the outer side is structured and dimensioned so that the plate may be held in one hand of a user together with a drinking cup, wherein when in use the user's finger fits in the groove and the raised edge of the outer side and the drinking cup are mated along the second surface of outer side. When holding the plate, the user's finger(s) may be separated from the food by the raised edge of the inner side of an incurvate portion, such that the user's fingers are effectively shielded from contacting any food or liquid held on the food-receiving surface. In certain aspects, the user may place one or more fingers in the groove, on the top side of the plate. When the user places one or more fingers in the groove on the top side of the plate, the user's fingers may be effectively shielded from coming into contact with any food or liquid held on the food-receiving surface by one or more raised edges separating the food-receiving surface from the user's finger(s).

In another aspect, a plate may include a food-receiving surface and a periphery, the periphery including a support structure, the support structure being positioned and dimensioned so that a user's finger may be placed through the support structure when holding the plate; and a raised lip around most of the food-receiving surface, the raised lip including a first surface and a second surface, the first surface positioned adjacent to the food-receiving surface, and the second surface positioned and dimensioned so as to be pressed against a drinking cup when holding the plate; where the support structure is placed so as to enable the user to hold the cup between the user's thumb and the second surface of the raised lip, when the user's finger is placed in the support structure. A plate may include a plurality of support structures. In some instances, a user may place the same finger through a plurality of support structures. In other instance, a user may instead place two or more different fingers through the plurality of support structures.

In another aspect, a plate may include a food-receiving surface and a periphery; the food-receiving surface having a top side and a bottom side, wherein food, when placed, is on the top side; the periphery being adjacent to and surrounding the food-receiving surface; wherein the bottom side of the food receiving surface comprises an incurvate portion extending away from the food-receiving surface, the incurvate portion including a first side and a second side; the incurvate portion corresponding generally with an arc that extends no more than about 180°; wherein the second side is structured and dimensioned so that the plate may be held in one hand of a user together with a drinking cup, wherein when in use the user places a finger along the first side, and the second side and the drinking cup are pressed together along a surface of second side.

Plates in accord with the current invention may vary in several ways. For example, plates may be shaped in any convenient shape, such as a circle, oval, ellipse, triangle, rhombus, square, parallelogram, irregular or arbitrary shapes. Plates may be formed from a variety of convenient materials and combinations thereof, including but not limited to compositions including plastics, paper, glass, composites, ceramics, and the like. Plates may comprise more than one material, e.g. a ceramic plate with a metallic edge, or a plastic plate with a polymer coating.

Plates may be dimensioned so as to be used by a particular type of user. For instance, plates may be of a size, shape, and material to be used primarily by juveniles or children, who have a smaller hand size than do adults. Plates intended to be used by juveniles or children may resemble animals, cartoons, characters, and the like, with an incurvate portion incorporated into the plate design. In other instances, plates may be designed for adult humans having a smaller-than-average hand size, average hand size, or above-average hand size. Plates may incorporate dimensions so as to be preferentially held by the user in the user's left hand, or the right hand.

Plates according to the instant invention may include an incurvate portion. A drinking cup may be placed adjacent to the incurvate portion, which may include physical features to allow the plate and drinking cup to be held together, using the same hand. An incurvate portion may include physical properties that differ from other parts of the plate. For example, an incurvate portion may be designed to include one or more features so as to have an increased coefficient of friction between the plate and a drinking cup than the plate would otherwise, such as through the inclusion of a different surface pattern, different surface material, adhesive, magnet, and the like. A plate may include more than one incurvate portion, wherein the plurality of incurvate portions may differ from one another in one or more properties such as size, shape, material, surface finish, and the like. In certain instances, an incurvate portion may be located in the periphery of the plate, or exterior to the periphery of the plate. An incurvate portion located in the periphery of the plate may cause the food-receiving surface adjacent to the incurvate portion to extend inward. An incurvate portion may be located in a position other than in the periphery of the plate, such as the top, bottom, etc.

Other aspects and embodiments of the invention will be readily apparent upon reading the present disclosure.

BRIEF DESCRIPTION OF THE DRAWINGS

The invention may be best understood from the following detailed description when read in conjunction with the accompanying drawings, which are not necessarily drawn to scale. Included in the drawings are the following figures.

DETAILED DESCRIPTION

Figure 1:
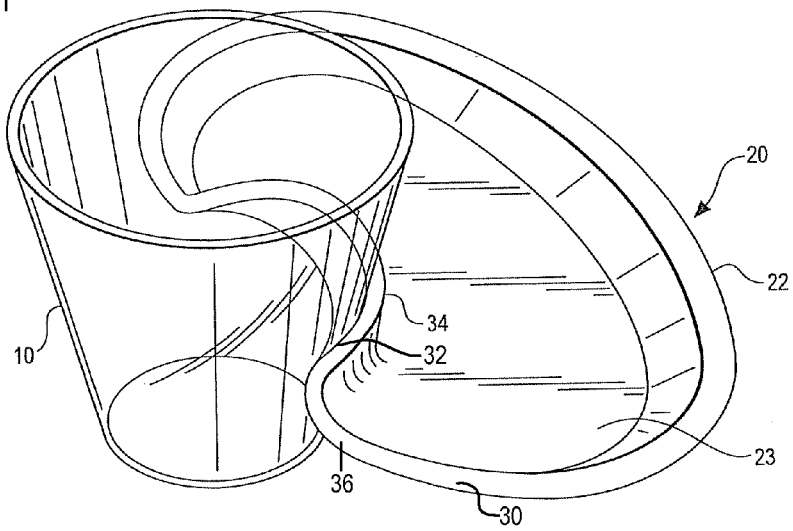
FIG. 1 is a perspective view of one embodiment of the plate shown next to a drinking cup, as the plate might be used.

Various plates that may be held along with a drinking cup are provided, where a user may hold a plate and a drinking cup in the same hand. A common feature of the instances presented herein is that the drinking cup is not attached to a plate, and does not rest on the plate or in an opening through the plate. Rather, the plate may provide one or more incurvate portions which facilitate holding a drinking cup and the plate simultaneously using the same hand. The subject designs may find use in various scenarios in which a user desires to hold a plate and a drinking cup simultaneously. The subject designs also may find use in various scenarios in which a user desires to hold a plate securely, in the presence or absence of a drinking cup.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" include plural referents unless the context clearly dictates otherwise. Thus, for example, reference to "a plate" includes a plurality of such plates and reference to "the incurvate portion" includes reference to one or more incurvate portions, and so forth.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

The present invention provides a novel and elegant solution to the problem of holding a plate in one hand together with a drinking cup while leaving the other hand free for other purposes, such as shaking hands, lifting food from the plate, and so forth. The present invention also provides a novel and elegant solution to the problem of securely holding a plate in one hand, in the presence or absence of a drinking cup.

The phrase "drinking cup" is used broadly and generically to refer to any cup, vessel, mug, can, bottle, glass, or other type of drinking apparatus of any kind or composition, an intended use of which is for a user to drink from the drinking cup a liquid contained in the drinking cup. Non-limiting examples of drinking cups as such term is used herein include beverage cans (e.g., soda cans, beer cans, wine cans, and the like), wine glasses (e.g., champagne flutes, stemware, stemless vessels, and the like), hot beverage containers (e.g., mugs, disposable paper cups, travel mugs and the like), etc. In accord with this definition, drinking cups may be any convenient shape, such as being roughly circular (when viewed from the top), square, rectangle, or any other shape, including arbitrary or irregular shapes.

A drinking cup may be held in one hand along with one or more plates. The term "plate" is used broadly and generically to refer to any kind of plate or similar food carrying apparatus, including but not limited to dinner plates, cocktail plates, saucers, serving trays, serving plates, bowl-type plates, bowls, and the like. Plates may be formed from any type of composition, non-limiting examples of which may include various plastic compositions, paper compositions, glass compositions, and the like. In certain embodiments, a plate may be constructed from more than one composition, e.g., a plate is formed from one composition, and a portion of the plate is made of one or more other compositions of a different type, as described further herein.

In certain instances, when a plate comprises multiple compositions, an incurvate portion is made out of a different composition from the rest of the plate. The phrase "incurvate portion" is used in the specification and claims to denote a region of a plate against which a drinking cup may be pressed, so structured and dimensioned such that the region presents a substantially complementary surface to an outside surface of the drinking cup, such that a user may hold the plate along with the drinking cup in the same hand by pressing the outside surface of the drinking cup against the substantially complementary surface of the incurvate portion.

In all embodiments, a drinking cup is not attached to a plate and does not rest on a plate or in an opening through a plate. Rather, a plate may be shaped, for example, to facilitate holding a drinking cup against an incurvate portion of the plate, where both the drinking cup and the plate can be held in one hand. While the incurvate portion might, in some embodiments, extend around a little more than a semi-circle, further extension around would limit the sizes and shapes of drinking cups that could be brought up against the incurvate portion and held comfortably together with the plate in one hand.

As described above, an incurvate portion may comprise a shape that is not a curve, and yet still be considered an incurvate portion herein. Some parts of the incurvate portion may be straight in some embodiments. For example, an incurvate portion may comprise a triangle shape, in which a drinking cup that has at least one angle may fit into the corner of the triangle, such that the drinking cup may fit against the incurvate portion of a periphery of the plate, and both the drinking cup and the plate can be held in one hand. Thus, in certain instances the shape and dimension of an incurvate portion may be designed to accommodate a particular type of drinking cup, such as a common 12 oz. aluminum drinking can, or a particular shape of drinking cup.

Because a drinking cup may contact a plate at one or more incurvate portions, an incurvate portion may have properties that differ from other regions of the plate. For example, in some instances an incurvate portion may include a material or pattern to enable the user to more easily hold the drinking cup and plate together in one hand. Any convenient material or pattern that would achieve this goal may be employed. For example, in certain aspects, a material or pattern may be added so as to increase the coefficient of friction between the drinking cup and the plate. Any convenient means of increasing the coefficient of friction between the drinking cup and the plate may be employed, such as including a grip-enhancing pattern on that portion of the plate (such as by, for example, adding grip-enhancing grooves, dimples, ridges, etc.), and/or including a different material (such as a rubber, adhesive, magnet, tacky composition, etc.).

In some instances, an incurvate portion may include a material or pattern that may reduce or eliminate the possibility of damaging a drinking cup held along with the plate. Those of skill in the art will readily appreciate that the particular materials and/or patterns may vary as a function of the material of the plate, the material of the drinking cup, the type of drinking cup, and the like.

Figure 2:
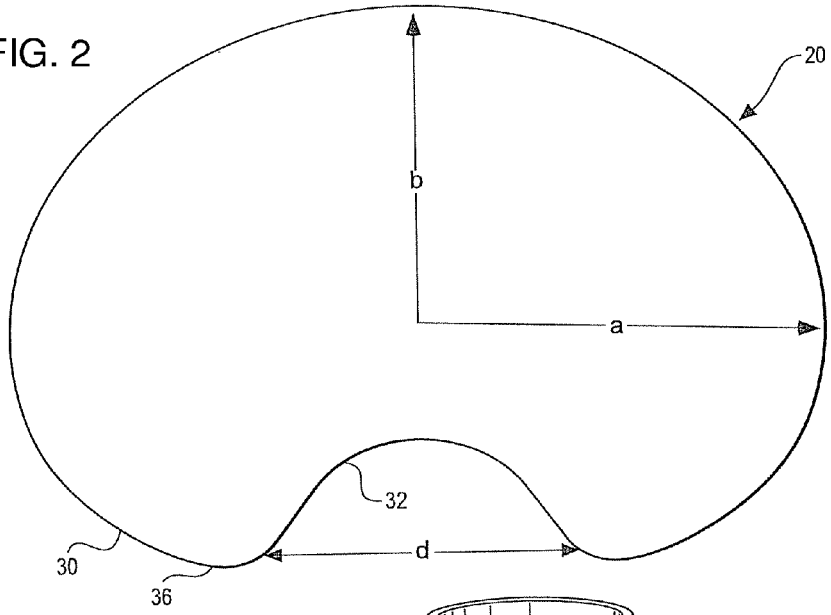
FIG. 2 is a top view of the plate shown in FIG. 1.
Figure 6:
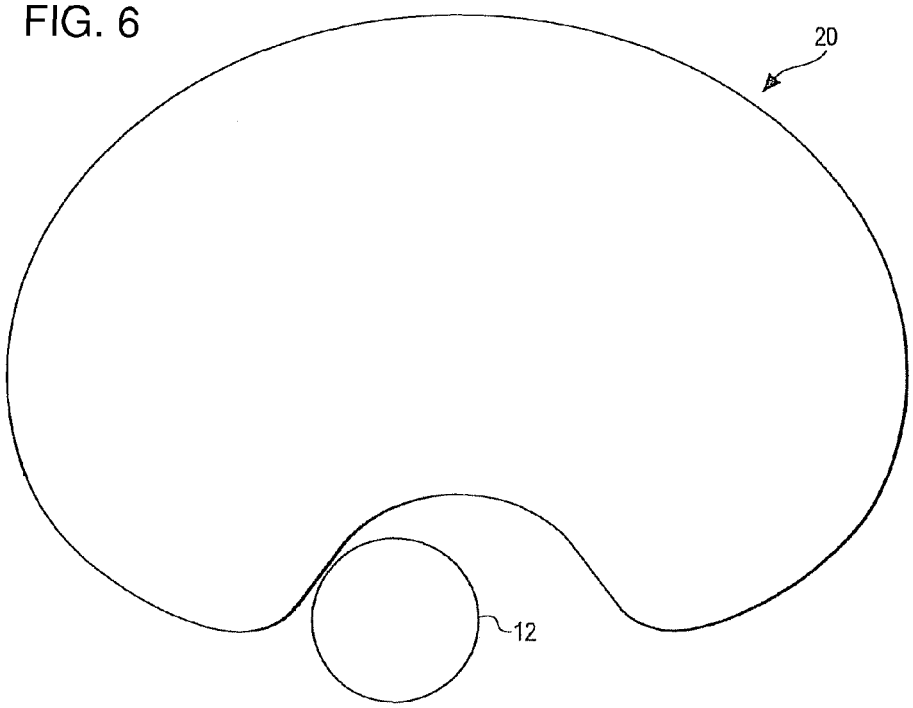
FIG. 6 is a top view of the plate shown in FIG. 1, shown next to a drinking cup with a smaller diameter than the drinking cup of FIG. 1.
Figure 7A:
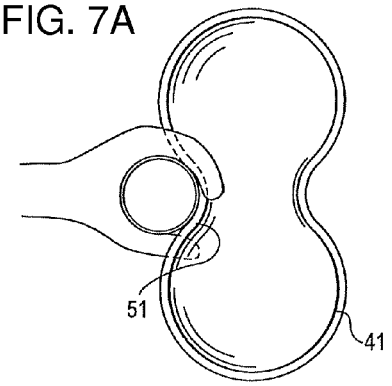
FIGS. 7A-7H are top views of different embodiments of the plate, respectively, each shown being held in one hand of a user together with a drinking cup.
Figure 7B:
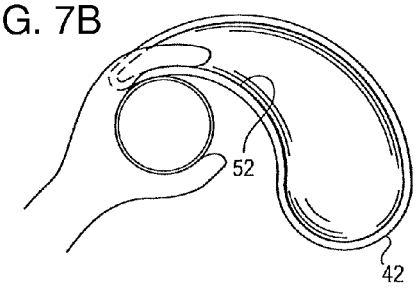
Figure 7C:
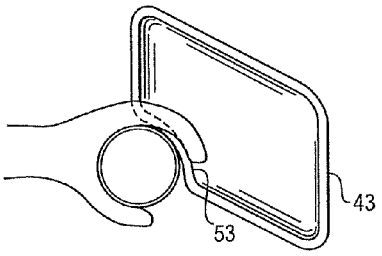
Figure 7D:
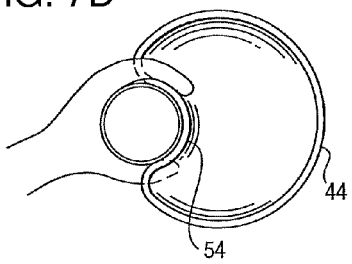
Figure 7E:
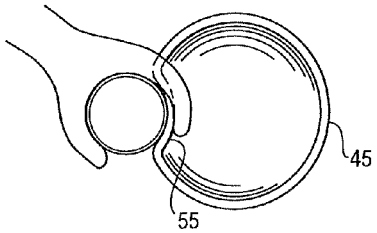
Figure 7F:
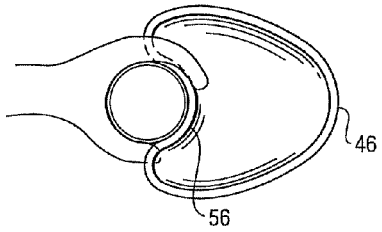
Figure 7G:
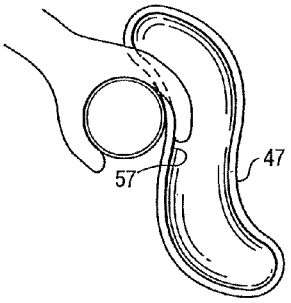
Figure 7H:
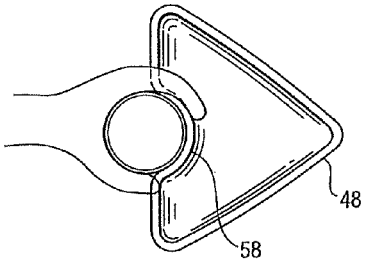

FIG. 1 is a perspective view of one embodiment of the plate 20 shown next to a drinking cup 10. A top view of plate 20 is illustrated in FIG. 2. The periphery 30 includes an incurvate portion 32 that curves inward. While the incurvate portion 32 corresponds generally with an arc, the curvature of the incurvate portion 32 may vary over its length. Indeed, some parts of the incurvate portion may be straight in some embodiments, and in some embodiments an incurvate portion may include only straight portions. For example, FIGS. 7A-7H show variously shaped embodiments 41-48 of the plate, respectively, each having differently curved incurvate portions 51-58. However, an arc generally corresponding with the entire incurvate portion should extend no more than about 180° (i.e., no more than about a semi-circle). In this way, the incurvate portion of a particular plate can be sized to be held comfortably against drinking cups of different shapes and diameters. For example, FIG. 6 illustrates an example of plate 20 being held against a drinking cup 12 with a smaller diameter than the drinking cup 10 of FIG. 1, and FIGS. 7B and 7G illustrate other examples of plates 42 and 47 being held against drinking cups that are smaller than might fit against incurvate portions 52 or 57.

Moreover, a plate may include more than one incurvate portion. For example, a plate may include about 2, about 3, or about 4 or more incurvate portions. In such embodiments, the incurvate portions may be substantially identical, or may differ from at least one other incurvate portion by a physical parameter, such as the size of the incurvate portion, the shape of the incurvate portion, the material of the incurvate portion, the surface texture or finish of the incurvate portion, and the like. For example, a plate having a plurality of incurvate portions may include one incurvate portion corresponding generally with a continuous arc, and an incurvate portion that does not correspond generally with a continuous arc. A plate may comprise a plurality of incurvate portions of similar type (e.g. both corresponding generally with a continuous arc), but have different sizes so as to facilitate holding different sized drinking cups, or different user hand sizes. That is, a first incurvate portion may be an arc with a larger diameter than a second incurvate portion, so as to accommodate larger diameter drinking cups, users with larger hands, etc. In other aspects, a first incurvate portion may, for example, be an arc or roughly circular, whereas a second incurvate portion may contain a straight region.

Returning to the example of FIG. 1, all of the incurvate portion 32 includes a raised edge 34 that is elevated in relation to an edge 36 of a portion of the periphery 30 that is immediately adjacent to the incurvate portion 32. A user's finger then can fit over an edge 36 of an immediately adjacent portion of the periphery 30 and along an inside surface of the raised edge 34. In this way, the plate 20 can be held in one hand together with a drinking cup 10, with an outside surface of the raised edge 34 and the drinking cup 10 being pressed against each other. The drinking cup 10 does not rest on the plate 20, per se. Rather, the drinking cup 10 and the plate 20 are both being held together in the same hand. The outside surface of the raised edge 34 and the drinking cup 10 are being pressed against each other, with a finger around the drinking cup 10 and a different finger along an inside surface of the raised edge 34. Other fingers fit underneath the plate 20 (and possibly around the drinking cup 10), and might help support the weight of the plate 20 and possibly the drinking cup 10. Accordingly, the dimensions of an incurvate portion and other dimensions of a plate may be chosen to accommodate a particular user's hand size. For example, a plate for use by a juvenile or child may have a smaller incurvate portion than would a plate for use by a large adult.

Figure 3:
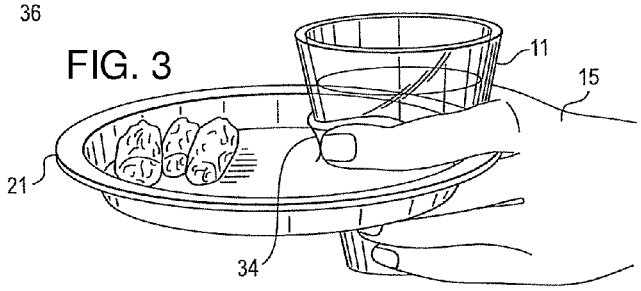
FIG. 3 is a perspective view of another embodiment of the plate, shown being held in one hand of a user together with a drinking cup.
Figure 4:
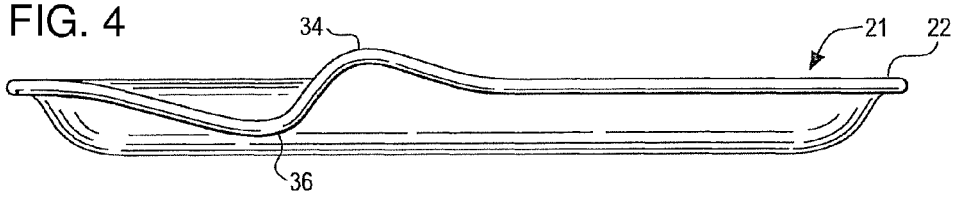
FIG. 4 is a side view of the plate shown in FIG. 3.
Figure 5:
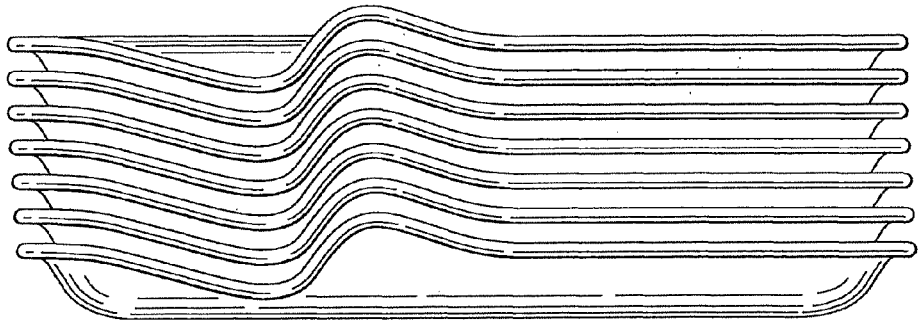
FIG. 5 is side view of a stack of plates, like the plate shown in FIG. 3.
Figure 8:
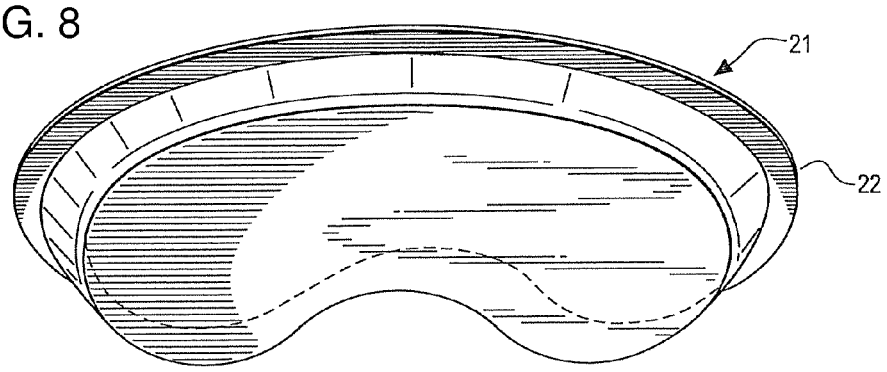
FIG. 8 is a bottom perspective view of the plate shown in FIGS. 3 and 4.

In FIG. 1, the raised edge 34 exists at the left-most and the right-most parts of the incurvate portion 32, and is elevated in relation to the edge 36 in portions of the periphery 30 immediately to the left and right of the incurvate portion 32. In that embodiment, the plate 20 is as functional for being held in either a left hand or a right hand together with a drinking cup 10. Other embodiments may be designed for use by only a left hand or by only a right hand. For example, FIG. 3 is a perspective view of plate 21 being held in a left hand 15 of a user together with a drinking cup 11. FIG. 4 shows a side view of plate 21, and FIG. 5 shows a stack of plates 21. FIG. 8 shows a bottom perspective view of the plate shown in FIGS. 3 and 4. As best seen in FIG. 4, plate 21 is shaped like plate 20, except that a raised edge 34 is highest at the left-most part of the incurvate portion which is elevated in particular in relation to the edge 36 in the portion of the periphery immediately to the left of the incurvate portion.

As best seen in FIGS. 1 and 4, some embodiments include a raised lip 22 along most of the periphery 30 (excluding the incurvate portion 32 and the edge 36 in the portions of the periphery immediately to the left or right of the incurvate portion 32) and, in some embodiments, extending outwardly in directions generally parallel to and away from a food-receiving surface 23 of the plate 20. By contrast, in at least some embodiments, an outside surface of the raised edge 34 of the incurvate portion 32 does not extend outwardly, and may lean inwardly as it rises to accommodate more easily drinking cups with greater diameters near the top of the drinking cup than near the bottom.

In some embodiments, the raised edge 34 of the incurvate portion 32 is elevated in relation to the raised lip 22, and the raised lip 22 is elevated in relation to the edge 36 in portions of the periphery 30 immediately to the left and right of the incurvate portion 32. In the example of FIGS. 3, 4, 5 and 8, plate 21 is a "left-handed" plate, and the raised lip 22 is elevated only in relation to the edge 36 in the portion of the periphery 30 that is immediately to the left of the incurvate portion 32.

Figure 9:
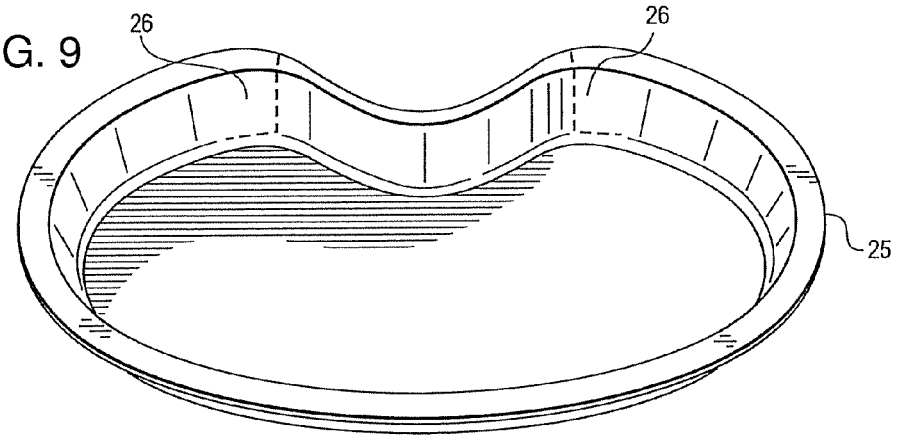
FIG. 9 is a perspective view of another embodiment of the plate.
Figure 10:
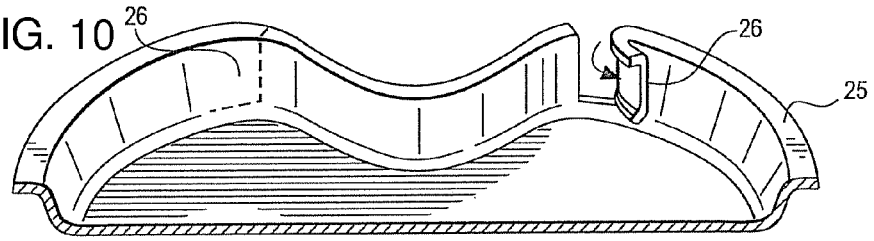
FIG. 10 is a partial perspective view of the plate shown in FIG. 9, with a finger slot moved open.
Figure 11:
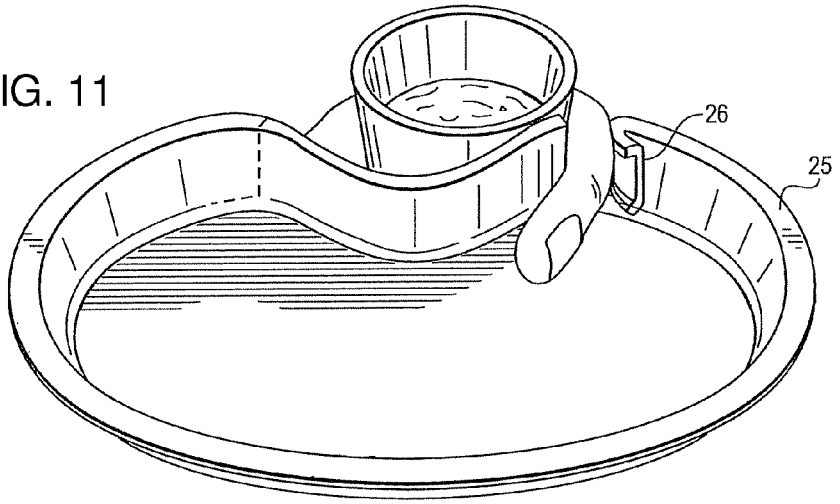
FIG. 11 is a perspective view of the plate of FIG. 9 shown with a finger in an open finger slot.
Figure 12:
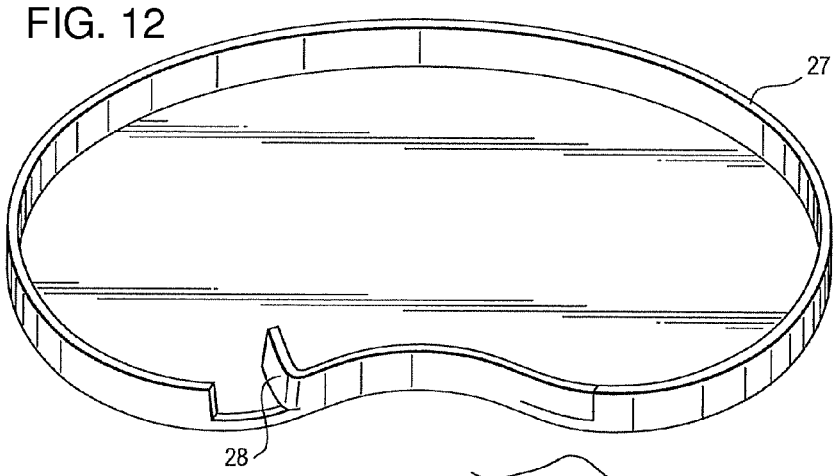
FIG. 12 is a perspective view of another embodiment of the plate.
Figure 13:
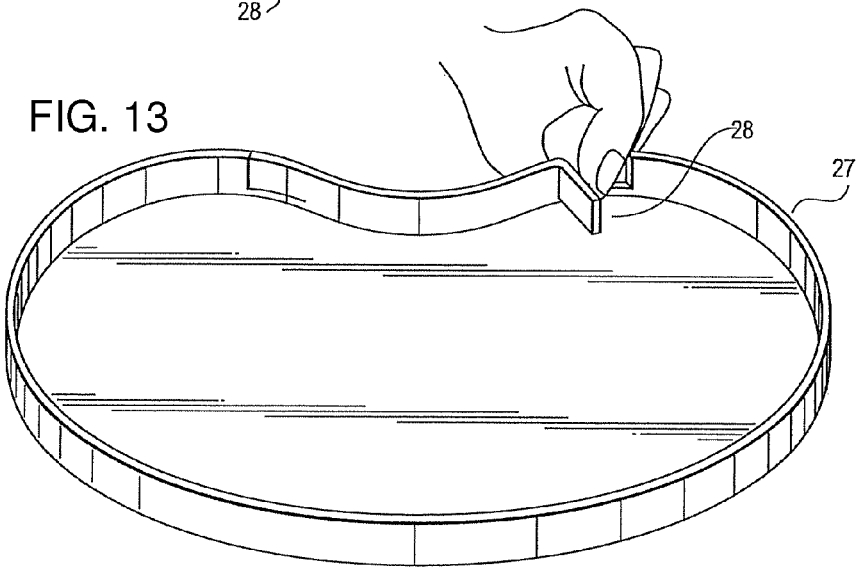
FIG. 13 is a perspective view of the plate shown in FIG. 12, with a finger slot moved open.
Figure 14:
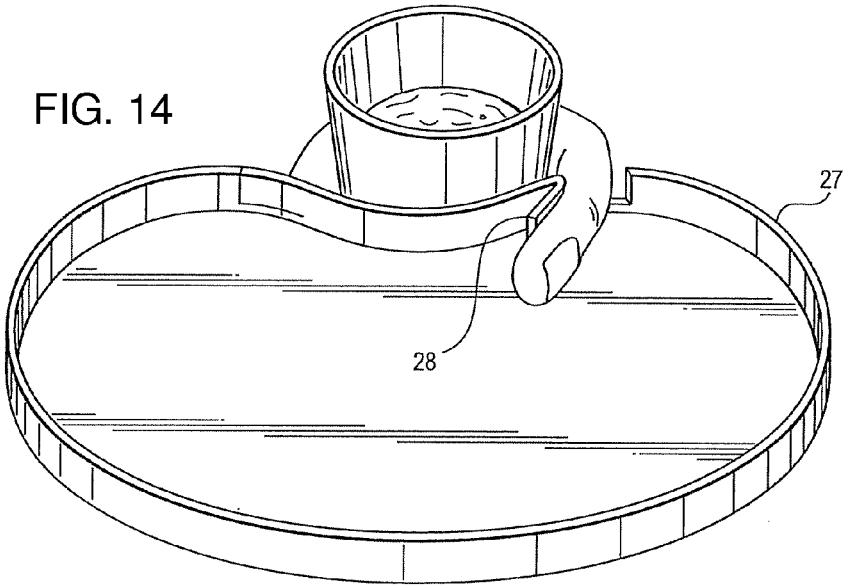
FIG. 14 is a perspective view of the plate of FIG. 12 shown with a finger in an open finger slot.

FIG. 9 shows a perspective view of a plate 25, in which the portions of the periphery immediately to the left and right of the incurvate portion are raised and include movable parts 26 that may be moved open to create finger slots. In FIG. 10, one of the parts 26 is shown in the "open" state so that a finger may fit through the finger slot and along the inside surface of the raised edge of the incurvate portion, as illustrated in FIG. 11. Similarly, FIGS. 12-14 show a plate 27 with a movable part 28 that opens in the opposite direction as the moveable part 26 in the embodiment of FIGS. 9-11.

Figure 19:
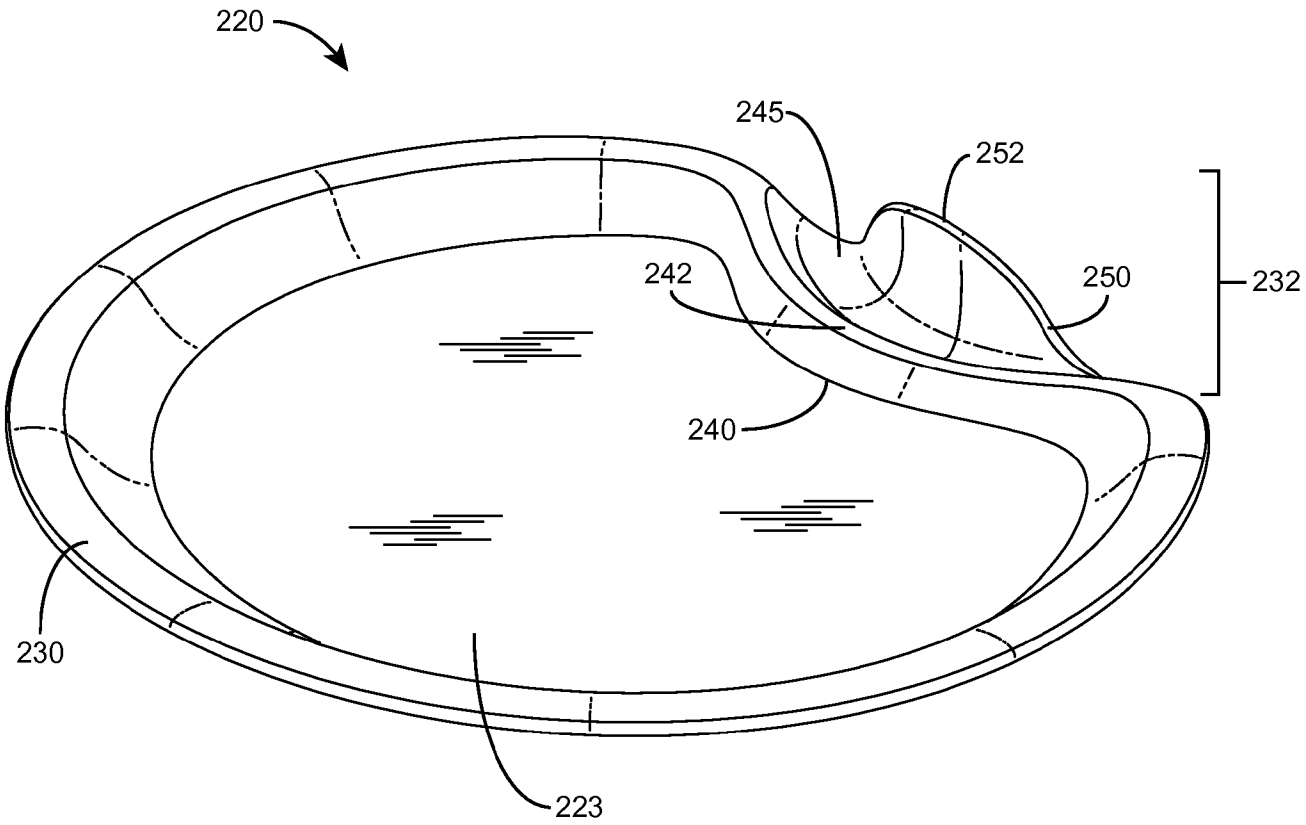
FIG. 19 is a top perspective view of one embodiment of the plate.
Figure 20:
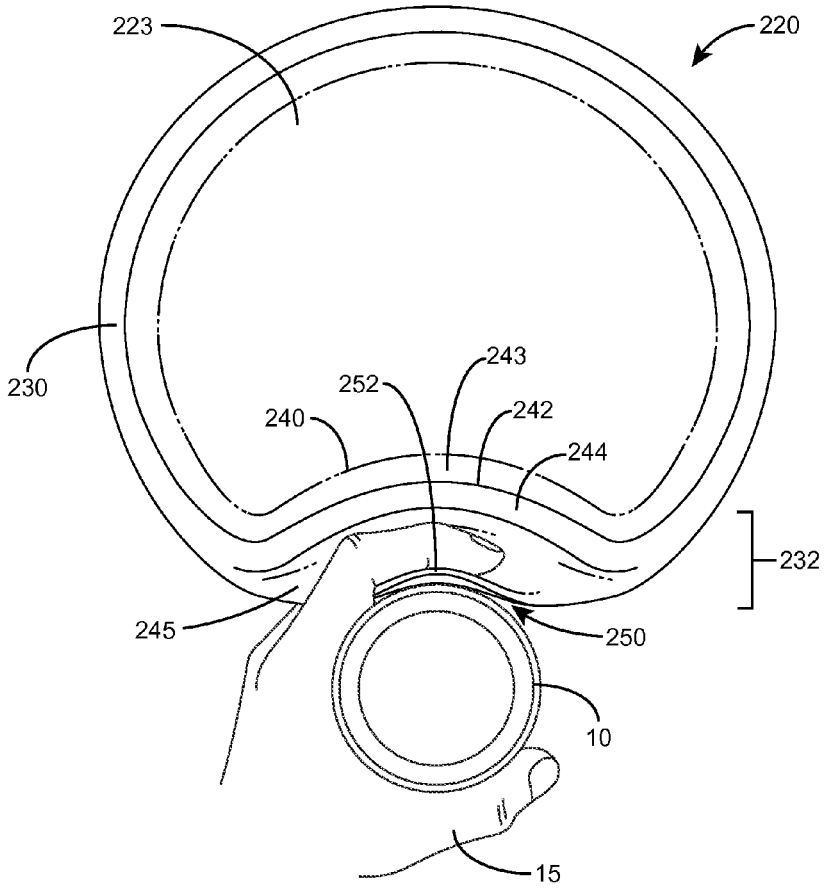
FIG. 20 is a top view of the plate shown in FIG. 19 next to a drinking cup, as the plate might be used.
Figure 21:
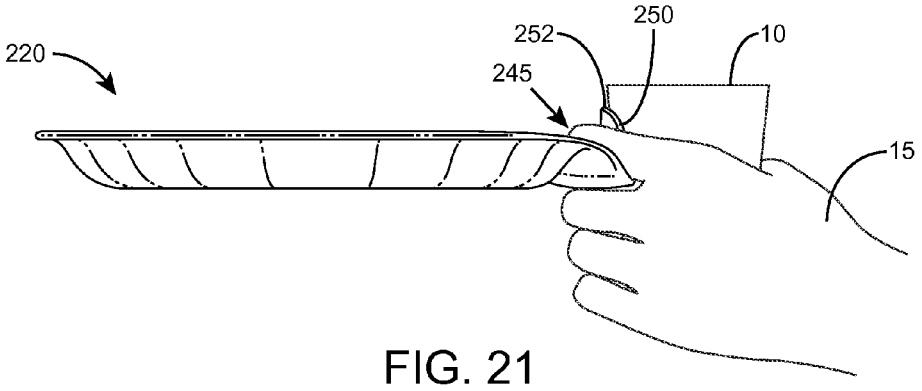
FIG. 21 is a side view of the plate shown in FIG. 19.
Figure 22:
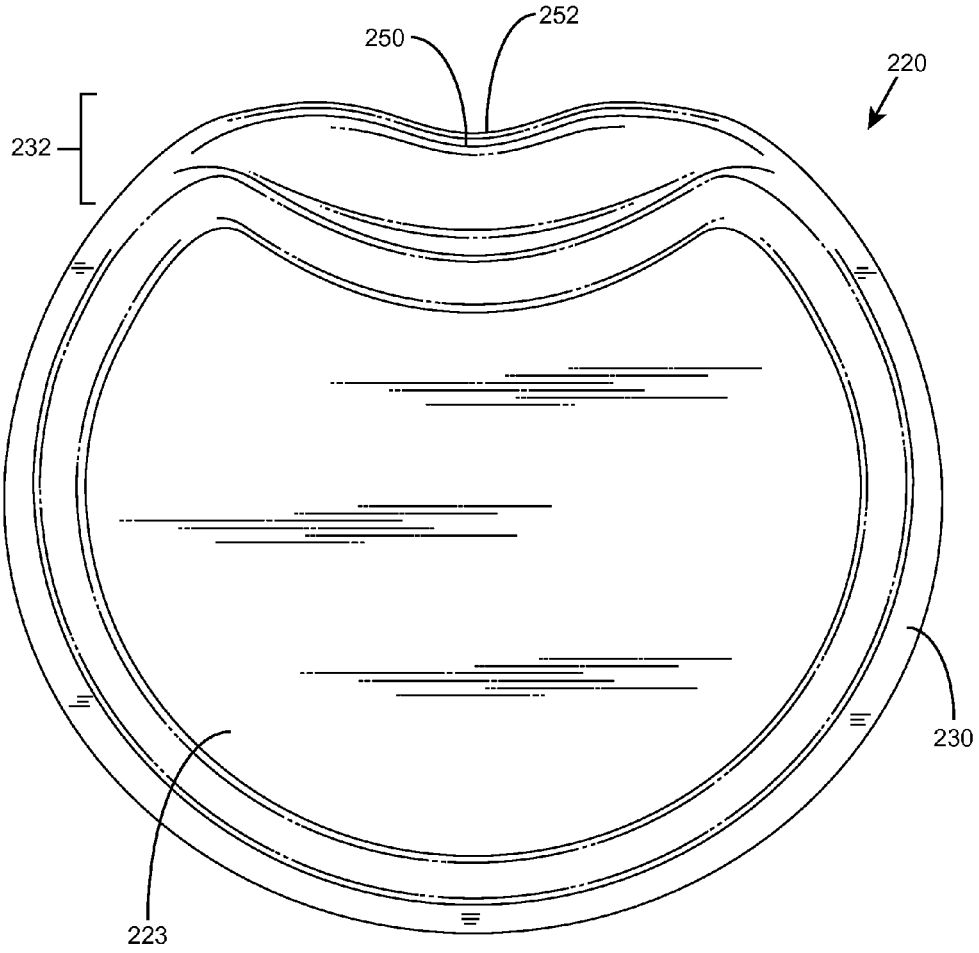
FIG. 22 is a bottom view of the plate shown in FIG. 19.
Figure 23:
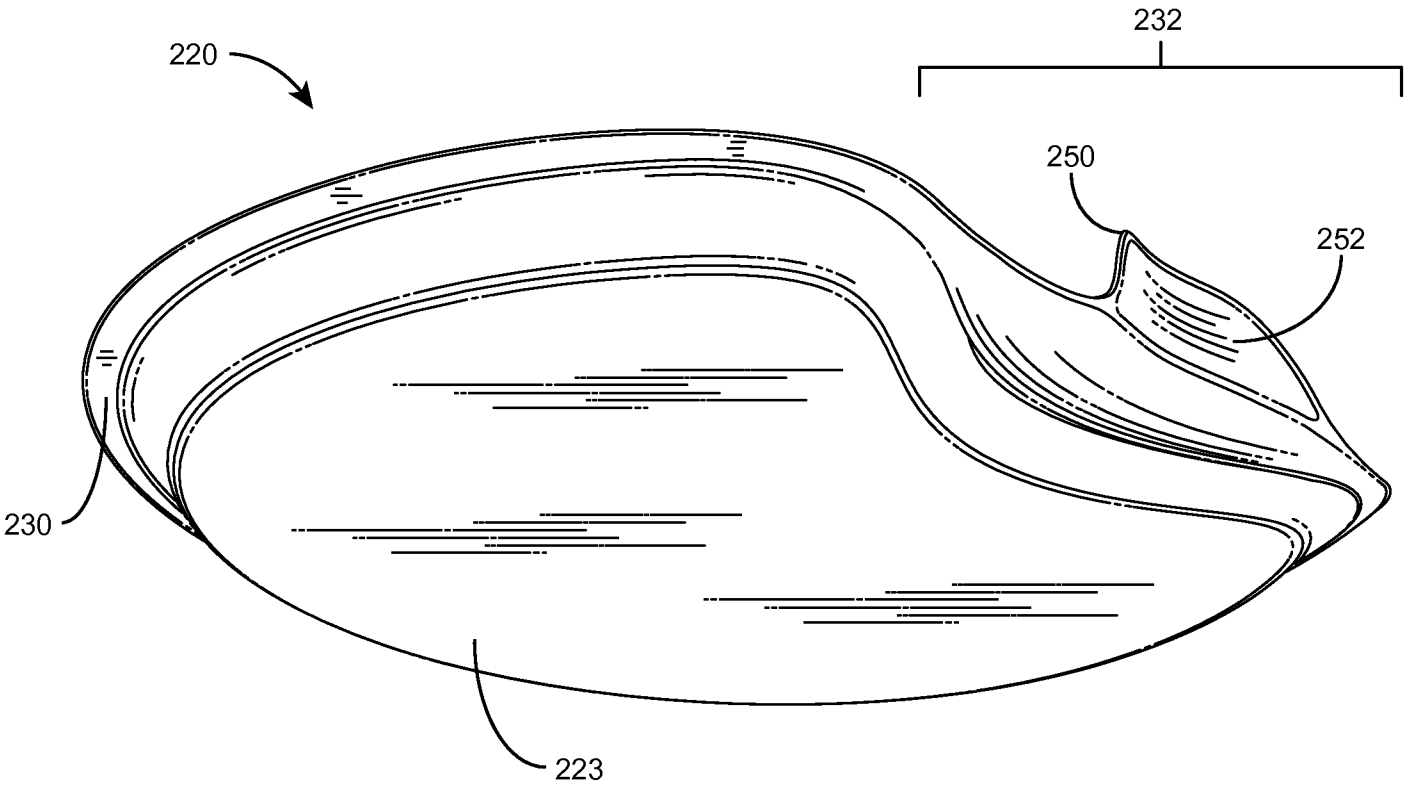
FIG. 23 is a bottom perspective view of the plate shown in FIG. 19.

FIGS. 16-17 and 20-21 show additional embodiments next to a drinking cup, as each plate might be used. In FIGS. 19-26, the plate 220 may be held in one hand along with a drinking cup. Turning to FIG. 19, the plate 220 comprises a food-receiving surface 223, a feature of which is that food or liquid may be placed upon this surface. The food-receiving surface 223 may be understood as having a top side and a bottom side, such that food, when placed, is on the top side. The plate 220 also includes a periphery 230, having an incurvate portion 232. The incurvate portion 232 includes an inner side 240 and an outer side 250. The inner side is adjacent to the food-receiving surface 223, and includes a raised edge 242 separating the food-receiving surface 223 from the outer side 250. As seen in FIG. 26, the raised edge 242 has a first surface 243 and a second surface 244. The first surface is adjacent to the food receiving surface 223. The outer side 250 includes a raised edge having a first surface and a second surface, wherein the first surface is opposite the second surface 244 of the raised edge 242. The outer side 250 is structured and dimensioned so that the plate may be held in one hand of a user together with a drinking cup, with the user's finger fitting in a groove 245 formed between the second surface 244 of the raised edge 242 of the inner side 240 and the first surface 253 of the raised edge 252 of the outer side 250. Turning again to FIG. 19, the groove 245 may be dimensioned so as to accommodate the user's finger, or a plurality of fingers. As shown by FIGS. 20-21, the raised edge 252 of the outer side 250 may be pressed against a drinking cup 10, with the raised edge 252 of the outer side 250 and the drinking cup 10 being pressed against each other along the second surface of outer side 250. FIGS. 22 and 23 show the bottom view and bottom perspective view, respectively, of the plate 220.

Figure 24:
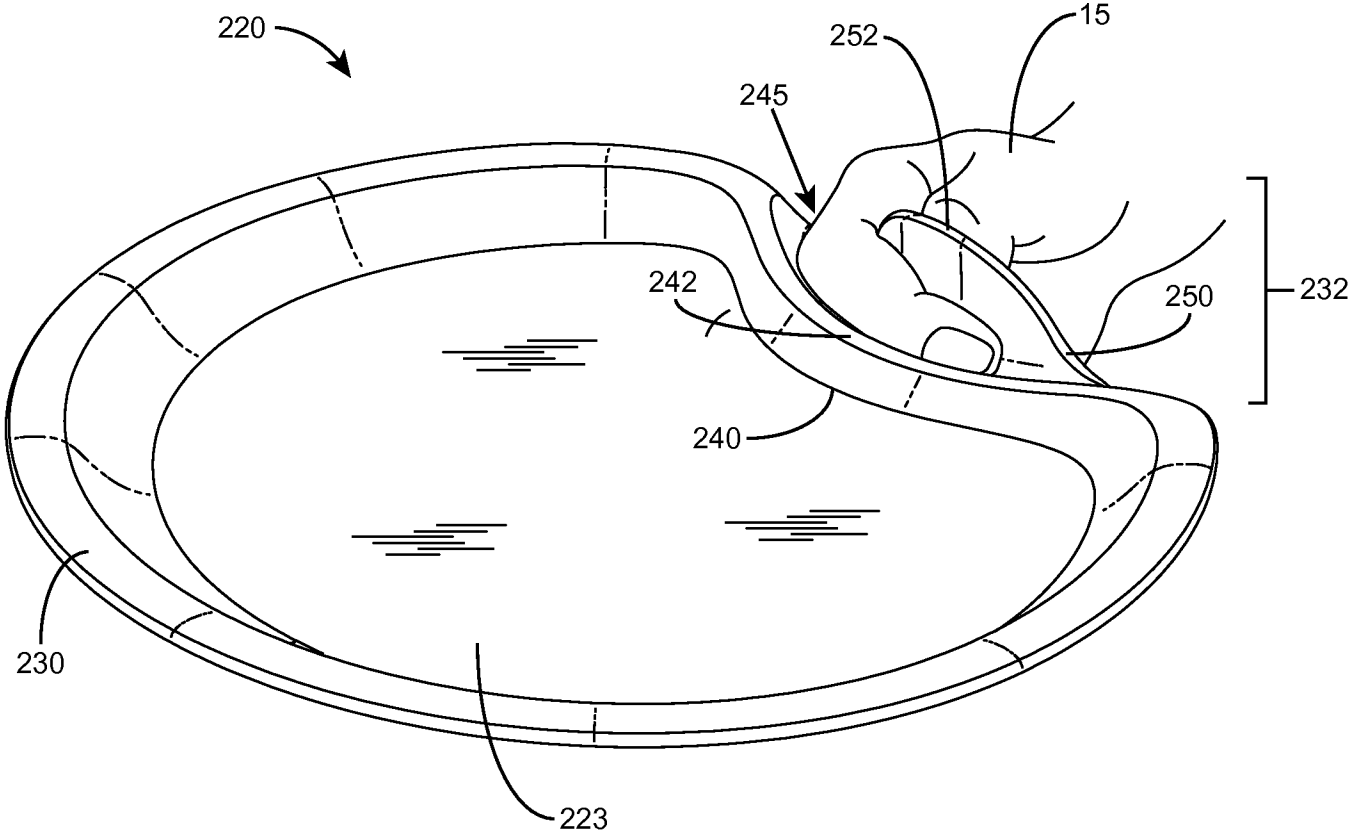
FIG. 24 is a top perspective view of the plate shown in FIG. 19, as the plate might be used in the absence of a drinking cup.

As is shown in FIG. 24, the plate 220 may be held in one hand 15 in the absence of a drinking cup. For example, a user may place one or more fingers in the groove 245, with one or more fingers pressed along the raised edge 252 of the outer side 250. Thus, the incurvate portion 232 may allow a user to hold a plate securely, in the presence or absence of a drinking cup.

The components of the incurvate portion 232 can be better understood from FIG. 26, which shows a cutaway view of the plate 220 that is shown in FIGS. 19-24. In this figure, the plate 220 has an incurvate portion 232. The incurvate portion 232 includes an inner side 240 and an outer side 250. The inner side is adjacent to the food-receiving surface 223, and includes a raised edge 242 separating the food-receiving surface 223 from the outer side 250. The raised edge 242 has a first surface 243 and a second surface 244. The first surface 243 is adjacent to the food receiving surface 223. The outer side 250 includes a raised edge 252 having a first surface 253 and a second surface 254, wherein the first surface 253 is opposite the second surface 244 of the raised edge 242. The outer side 250 is structured and dimensioned so that the plate may be held in one hand of a user together with a drinking cup, with the user's finger fitting in a groove 245 formed between the second surface 244 of the raised edge 242 of the inner side 240 and the first surface 253 of the raised edge 252 of the outer side 250. The groove 245 may be dimensioned so as to accommodate the user's finger, or a plurality of fingers. The raised edge 252 of the outer side 250 may be pressed against a drinking cup, with the raised edge 252 of the outer side 250 and the drinking cup being pressed against each other along the second surface 254 of the outer side 250.

Figure 15:
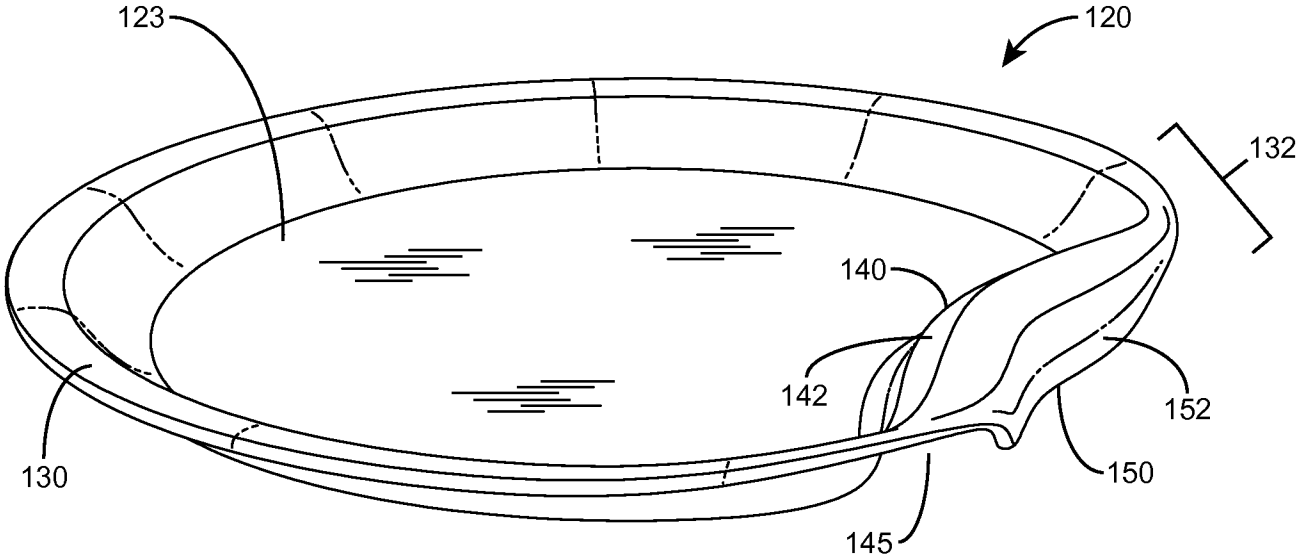
FIG. 15 is a perspective view of one embodiment of the plate.
Figure 16:
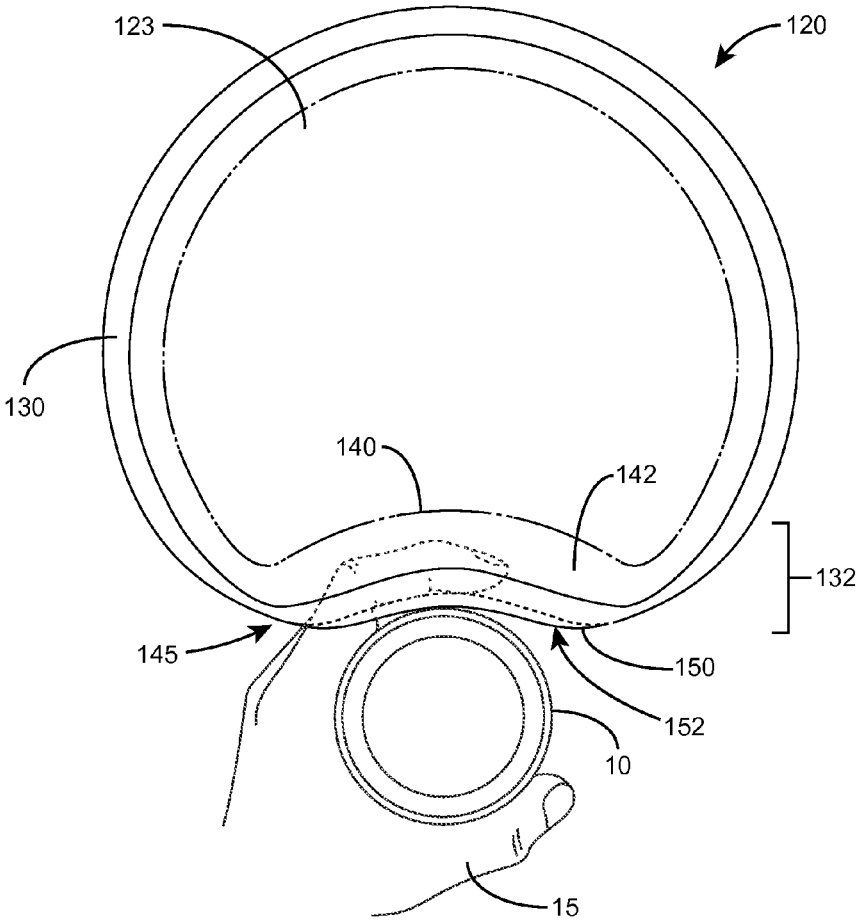
FIG. 16 is a top view of the plate shown in FIG. 15 next to a drinking cup, as the plate might be used.
Figure 17:
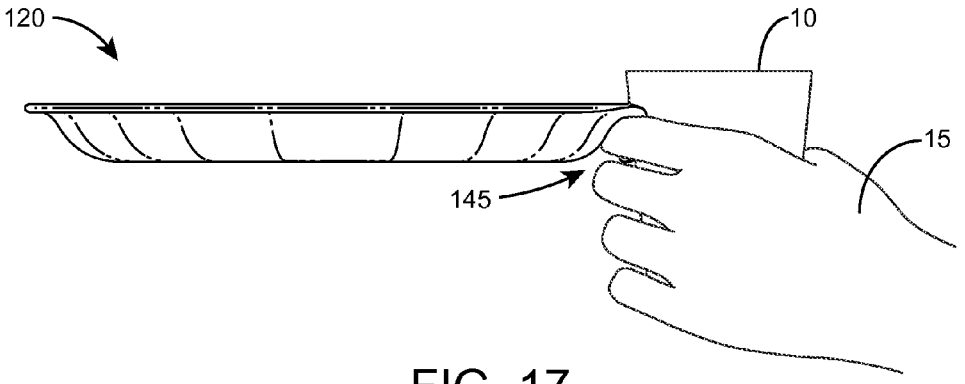
FIG. 17 is a side view of the plate shown in FIG. 15.

Similarly, in FIGS. 16-17, a plate 120 can be held in one hand 15 along with a drinking cup 10. As seen in FIG. 15, the plate 120 comprises a food-receiving surface 123, a feature of which is that food or liquid may be placed upon this surface. The food-receiving surface 123 may be understood as having a top side and a bottom side, such that food, when placed, is on the top side. The plate 120 also includes a periphery 130, having an incurvate portion 132. The incurvate portion includes an inner side 140 and an outer side 150. The inner side is adjacent to the food-receiving surface, and includes a raised edge separating the food-receiving surface 123 from the outer side 150. The outer side 150 includes a raised edge 152 having a first surface and a second surface, wherein the outer side 150 is structured and dimensioned so that the plate may be held in one hand of a user together with a drinking cup, with the user's finger fitting in a groove formed between the raised edge 142 of the inner side 140 and the first surface of the raised edge 152 of the outer side 150. The groove may be dimensioned so as to accommodate the user's finger, or a plurality of fingers. As depicted in FIG. 16, the raised edge 152 of the outer side 150 may be pressed against the drinking cup 10, with the raised edge 152 of the outer side 150 and the drinking cup being pressed against each other along the second surface of outer side 150.

Figure 18:
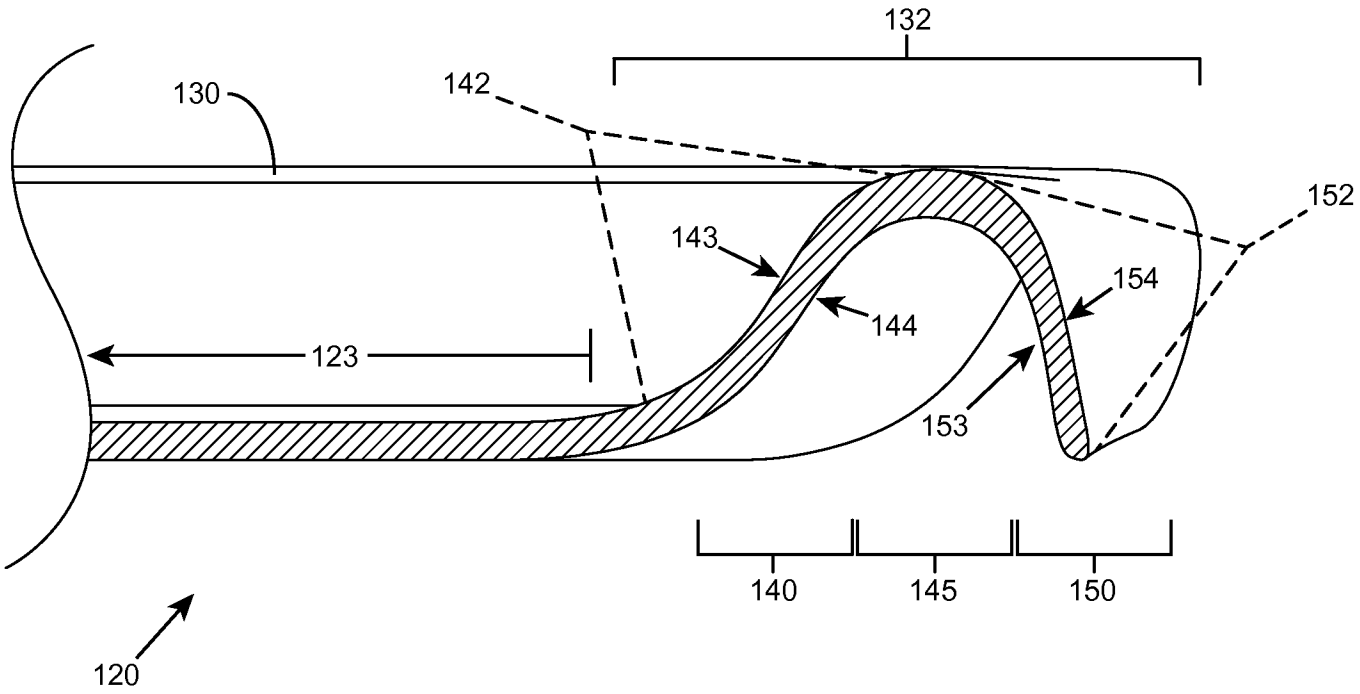
FIG. 18 is a cross-sectional view of the plate shown in FIG. 15.

The components of the incurvate portion 132 can be better understood from FIG. 18, which shows a cutaway view of the plate 120 that is shown in FIGS. 15-17. In this figure, the plate 120 has an incurvate portion 132. The incurvate portion 132 includes an inner side 140 and an outer side 150. The inner side is adjacent to the food-receiving surface 123, and includes a raised edge 142 separating the food-receiving surface 123 from the outer side 150. The raised edge 142 has a first surface 143 and a second surface 144. The first surface 143 is adjacent to the food receiving surface 123. The outer side 150 includes a raised edge 152 having a first surface 153 and a second surface 154, wherein the first surface 153 is opposite the second surface 144 of the raised edge 142. The outer side 150 is structured and dimensioned so that the plate may be held in one hand of a user together with a drinking cup, with the user's finger fitting in a groove 145 formed between the second surface 144 of the raised edge 142 of the inner side 140 and the first surface 153 of the raised edge 152 of the outer side 150. The groove 145 may be dimensioned so as to accommodate the user's finger, or a plurality of fingers. The raised edge 152 of the outer side 150 may be pressed against the drinking cup, with the raised edge 152 of the outer side 150 and the drinking cup being pressed against each other along the second surface 154 of the outer side 150.

As shown by FIGS. 15-26, the groove may be positioned such that user may place one or more fingers on the top side of the plate (such as in the embodiment depicted in FIGS. 19-26), or such that all of a user's fingers are placed on the bottom side of the plate (such as in the embodiment depicted in FIGS. 15-18). FIGS. 18 and 26 most clearly depict the raised edges 142 and 242, respectively. In the embodiment shown in FIGS. 19-26, when a user places one or more fingers on the top side of the plate in groove 245, the raised edge 242 may be high enough such that any food or liquid contained in or on the food-receiving surface 223 does not contact the user's finger. Accordingly, a user may hold the plate 220 shown in FIGS. 19-26, with one or more fingers on the top side of the plate, without any food or liquid contained in or on the food-receiving surface contacting the fingers. The precise height of the raised edge 242 may be about 0.1 to 12.5 cm or more. For example, the height of the raised edge 242 may be at least 0.5 cm or more, about 1 cm or more, about 2 cm or more, about 3 cm or more, about 4 cm or more, about 5 cm or more, about 6 cm or more, about 7 cm or more, about 8 cm or more, about 9 cm or more, about 10 cm or more, about 11 cm or more, about 12 cm or more, or about 12.5 cm or more. The precise height, width, and other dimensions of the raised edge 242 may be readily determined by one of skill in the art such that the raised edge 242 effectively shields the user's finger(s) from contacting any food or liquid held on the food-receiving surface 223.

In the embodiment illustrated in FIGS. 15-18, the raised edge 142 effectively forms one side of the groove 145, under which the user places his or her fingers. Thus, the user's fingers are again effectively shielded by the raised edge 142 from contacting any food or liquid held on the food-receiving surface 123.

Figure 37:
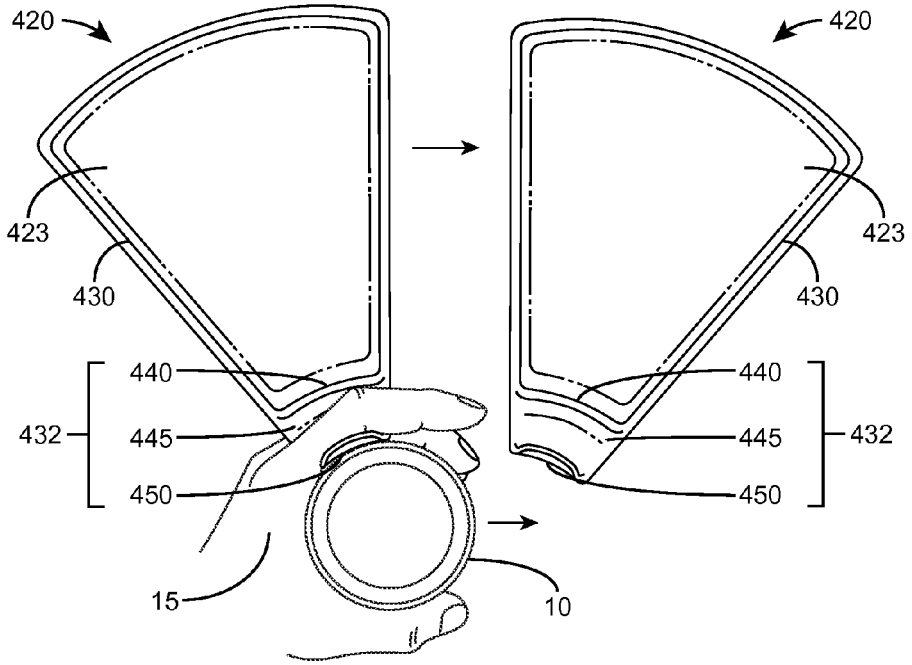
FIG. 37 is a top view of one embodiment in which a user can hold a plurality of plates and a drinking cup in the same hand.
Figure 38:
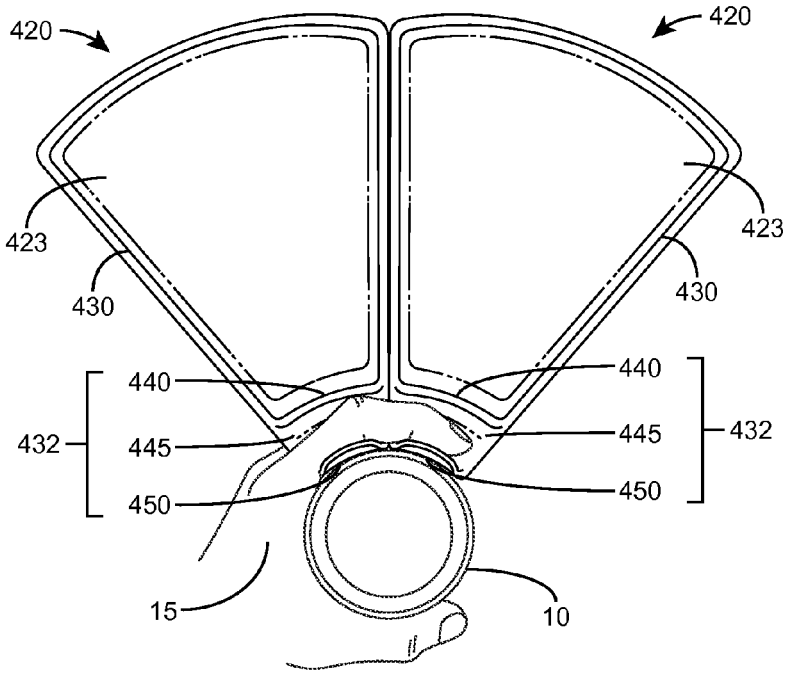
FIG. 38 shows a plurality of plates as shown in FIG. 37, as the plates might be used.

In certain embodiments, a plurality of plates may be held in one hand along with a drinking cup. For example, FIGS. 37-38 depict an embodiment in which a plurality of plates 420 may be held in one hand 15 along with a drinking cup 10. In FIGS. 37-38, each plate 420 contains a food-receiving surface 423, a periphery 430, and an incurvate portion 432, the incurvate portion having an inner side 440, a groove 445, and an outer side 450. FIG. 38 shows how a plurality of such plates 420 are dimensioned such that the incurvate portions may be held using the same fingers against a drinking cup 10. In certain embodiments, 2 or more plates may be held in such a manner, such as 2 plates, 3 plates, 4 plates, etc.

Figure 25:
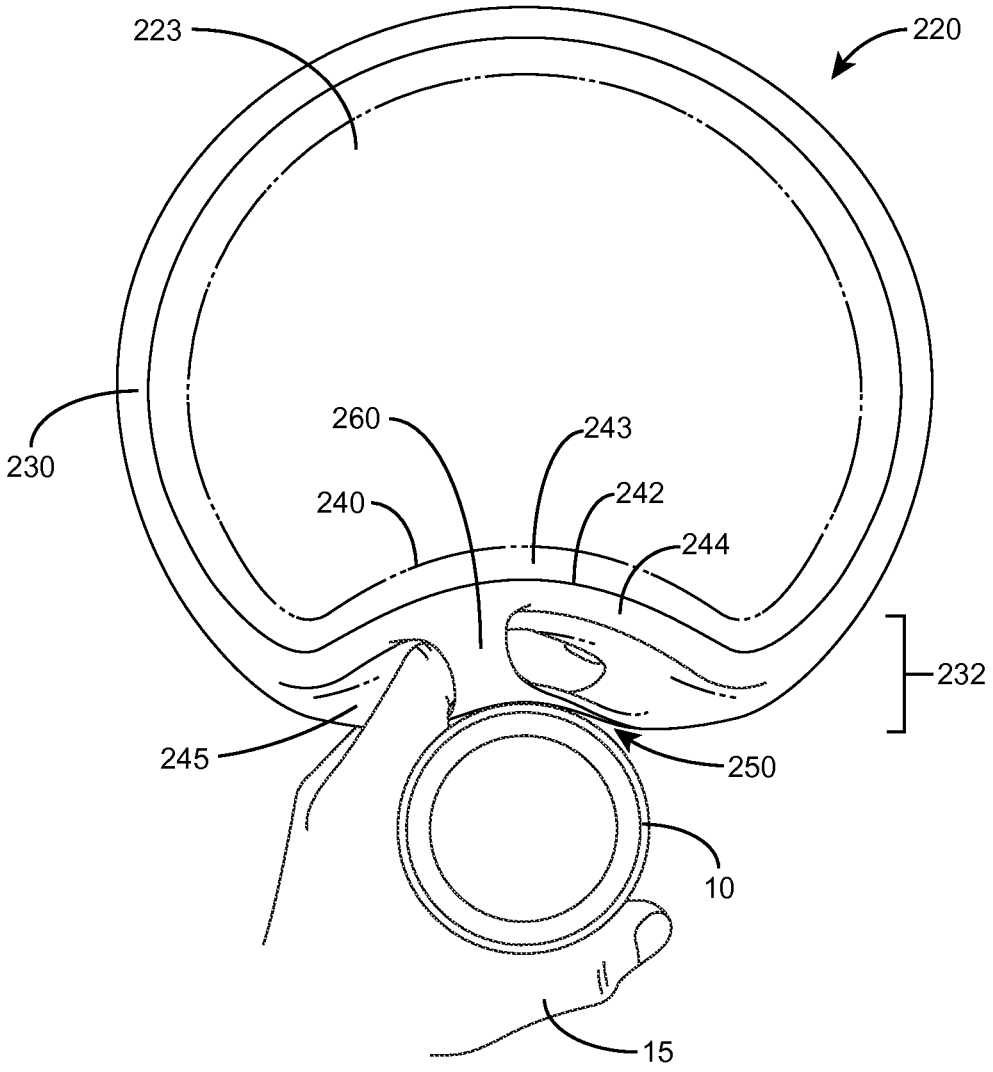
FIG. 25 is a top view of the plate shown in FIG. 19, wherein the plate includes a support structure.
Figure 26:
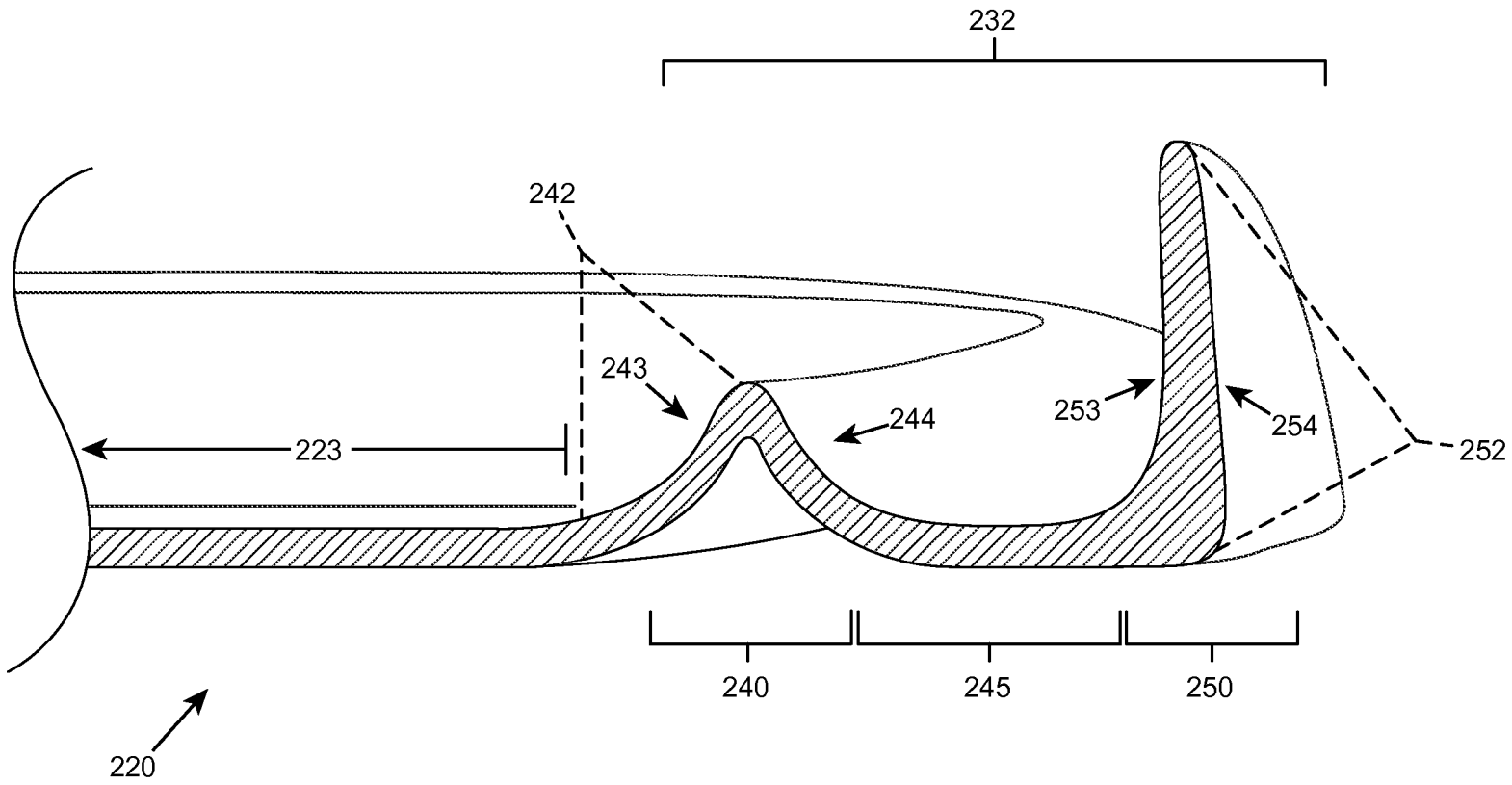
FIG. 26 is a cross-sectional view of the plate shown in FIG. 19.
Figure 33:
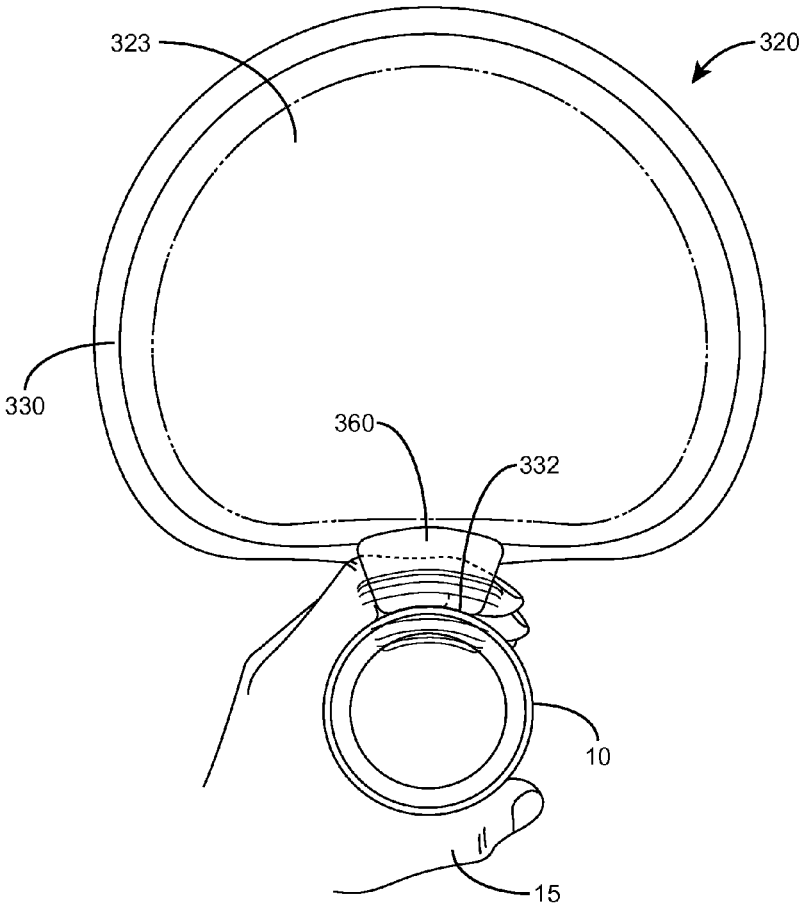
FIG. 33 is a top view of one embodiment of the plate shown next to a drinking cup, as the plate might be used.
Figure 34:
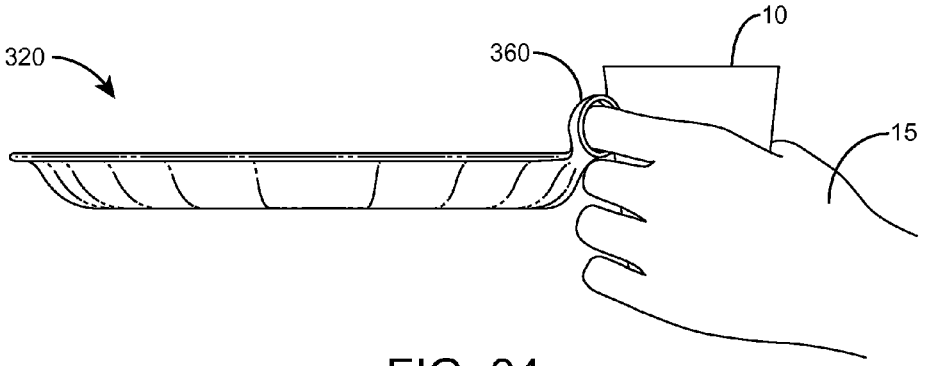
FIG. 34 is a side view of the plate shown in FIG. 33.
Figure 35:
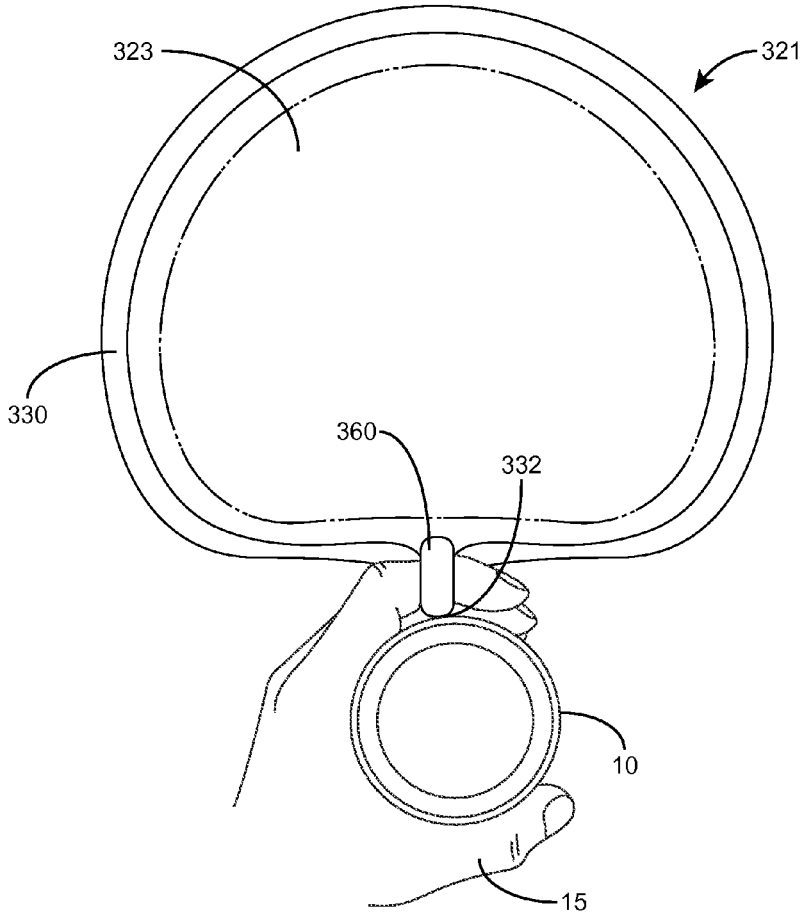
FIG. 35 is a top view of one embodiment of the plate shown next to a drinking cup, as the plate might be used.
Figure 36:
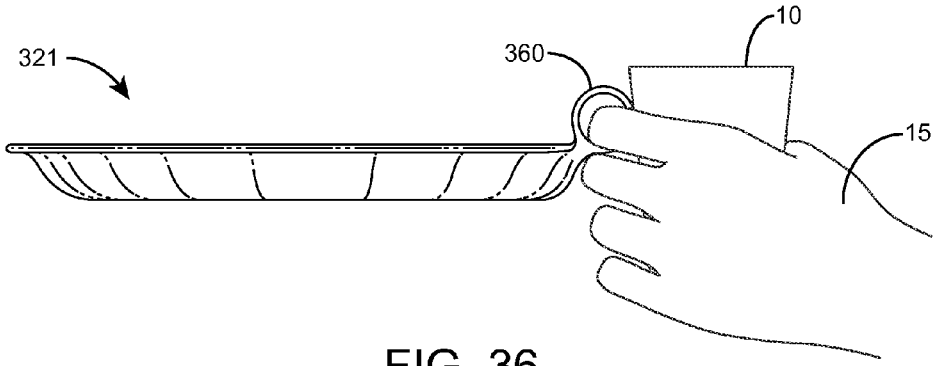
FIG. 36 is a side view of the plate shown in FIG. 35.

FIGS. 25 and 33-36 show embodiments in which one or more of a user's fingers is placed through an additional support structure, so as to facilitate holding of the plate and cup in one hand. In FIGS. 33-34, the plate 320 includes a structure 360 positioned such that a user's finger is placed through the support structure 360, where the support structure 360 is located in the incurvate portion 332. The plate 320 comprises a food-receiving surface 323 and a periphery 330. In some embodiments, the support structure 360 may be formed by a portion of the raised edge of the inner side reverting back toward the raised edge of the outer side and may be dimensioned so that, when in use, a user's finger may be placed in the groove. In some embodiments, the support structure 360 may instead be formed by a portion of the raised edge of the outer side reverting back toward with the raised edge of the inner side and may be dimensioned so that, when in use, a user's finger may be placed in the groove. In certain aspects, when the raised edge of the inner side reverts back toward the raised edge of the outer side (i.e., the opposite side), or when the raised edge of the outer side reverts back toward the raised edge of the inner side (i.e., the opposite side), the two sides may connect. In FIG. 25, for example, the structure 260 can be understood as the raised edge 242 of the inner side 240 extending to connect with the raised edge of the outer side 250, or vice versa, thereby creating the support structure 260. In other embodiments, the raised edge of one side (e.g., an inner side, or an outer side) may revert back toward the raised edge of the opposite side (e.g., the outer side, or the inner side, as applicable) and the two may not connect.

The structures such as those depicted as 260 or 360 may be referred to as a "structure" and/or "support structure" herein, and the use of these phrases is not necessarily meant to be limiting as to the shape, size, dimension, and the like of the structure. One or more support structures may be incorporated into any of the embodiments described herein. In some instances, a support structure is a closed, roughly circular shape dimensioned so that a user may insert one finger. In some instances, a support structure is not closed, but rather may comprise an opening such that it does not create a completely enclosed volume. Moreover, in some instances a support structure is not circular, but rather may be any other convenient shape, such as an oval, rectangle, or complex shape. The support structure may be made from any convenient composition, and may be the same composition as the plate or a different composition. As is clear from FIGS. 33-34, a support structure may cover all or substantially all of a user's finger. In such embodiments, the support structure may itself comprise an incurvate portion 332. In certain such embodiments, the presence of the incurvate portion will not cause the plate and/or the food-receiving surface to extend inward. In FIG. 33, for example, the presence of the curved incurvate portion does not create a similar or analogous curve in either the periphery 330 or food-receiving surface 323 of the plate. In certain embodiments, the support structure may itself effectively shield the user's fingers from contacting any food or liquid held on the food-receiving surface of the plate. In other embodiments, such as plate 321 in FIGS. 35-36, a support structure 360 may cover only a small portion of the user's finger.

In certain aspects, a plurality of support structures may be incorporated into one plate. A plurality of support structures may be positioned and dimensioned so that a user places one finger through a plurality of support structures. A plurality of support structures may be positioned and dimensioned so that a user places more than one finger through support structures. For instance, an embodiment as in any of FIGS. 25 and 33-36 may comprise a plurality of support structures placed in the groove such that a user's finger passes through a plurality of support structures, and the plate may further comprise one or more support structures such that another finger may pass through one or more other support structures.

Figure 42:
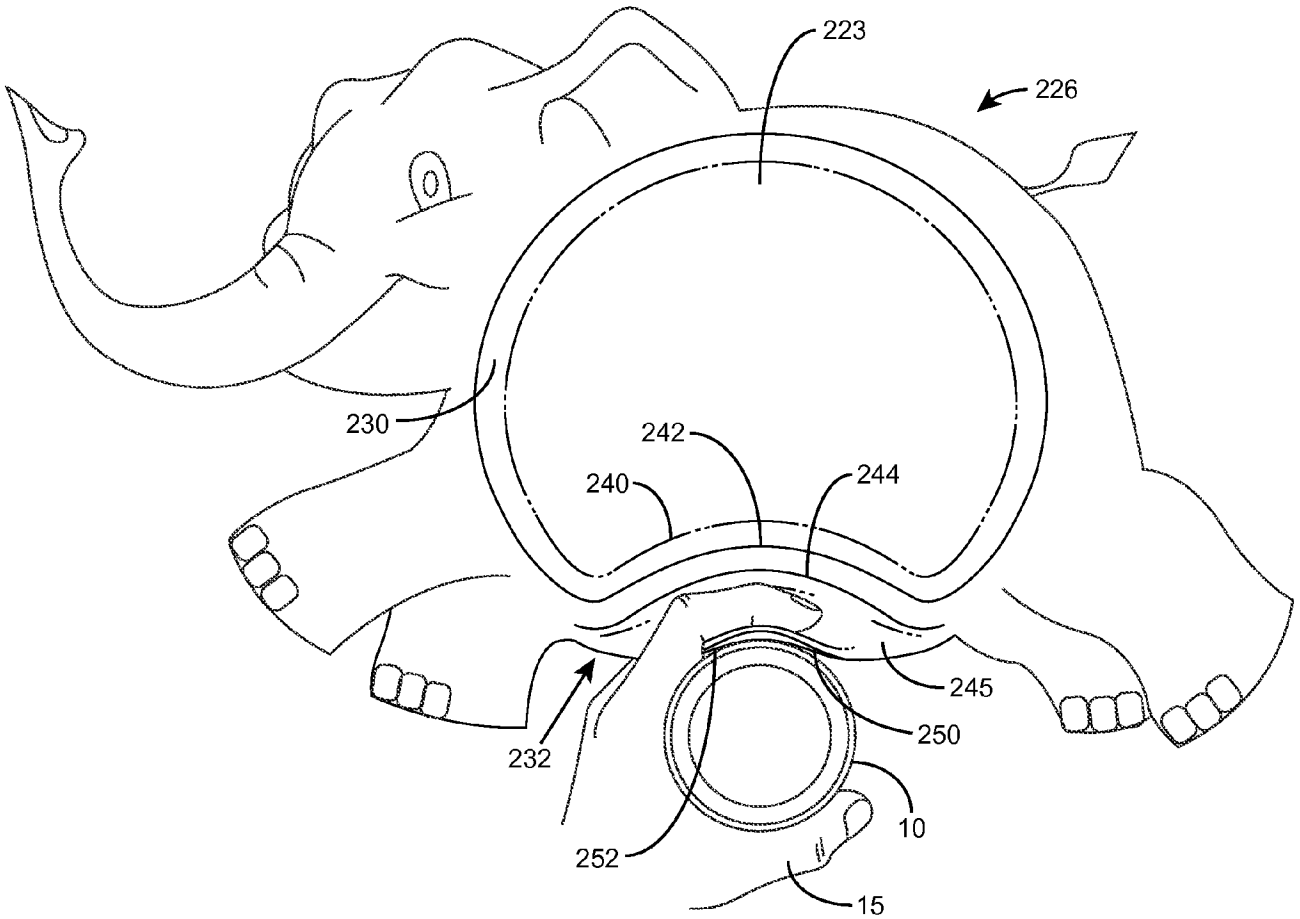
FIG. 42 is a top view of one embodiment of the plate formed into the shape of an animal. An incurvate portion is formed in the space between the front and rear legs.

As seen in the examples of plates 41-48 in FIGS. 7A-7H, and plate 226 in FIG. 42, the plate can be of various shapes and dimensions and yet there may be an incurvate portion that can be pressed against a drinking cup. For example, the periphery may be generally circular, triangular, tear-drop shaped, parallelogram-shaped, etc. In the embodiment of FIGS. 1 and 2, the periphery 30 is generally oval in shape except for the incurvate portion 32. The center of mass of plate 20 is located closer to a point in the incurvate portion 32 than to any other point in the periphery 30. In the embodiment illustrated in FIG. 2, the oval shape of the periphery 30 corresponds generally with an ellipse, with a ratio of its semi-major axis "a" to its semi-minor axis "b" of between about 1.4 and about 1.5. In FIG. 2, the shortest distance between any two points, respectively, in the portions of the periphery 30 immediately to the left and right of the incurvate portion 32 is labeled as the linear distance "d". In the embodiment of FIG. 2, a ratio of the linear distance "d" to the semi-minor axis "b" is between about 1.25 and about 1.30. In the embodiment of FIG. 42, the plate 226 is in the general shape of an animal, namely an elephant, with an incurvate portion 232 formed in the void between the front and rear legs. The plate 226 of FIG. 42 comprises a food-receiving surface 223, and includes a raised edge 242 separating the food-receiving surface 223 from the outer side 250. The outer side 250 is structured and dimensioned so that the plate may be held in one hand of a user together with a drinking cup, with the user's finger fitting in a groove 245 formed between the second surface 244 of the raised edge 242 of the inner side 240 and the first surface of the raised edge 252 of the outer side 250. The groove 245 is dimensioned so as to accommodate the user's finger. The raised edge of the outer side 250 is pressed against the drinking cup 10, with the raised edge of the outer side 250 and the drinking cup 10 being pressed against each other along the second surface of outer side 250. Accordingly, plates may be formed in any convenient shape, including irregular or abstract shapes.

Figure 39:
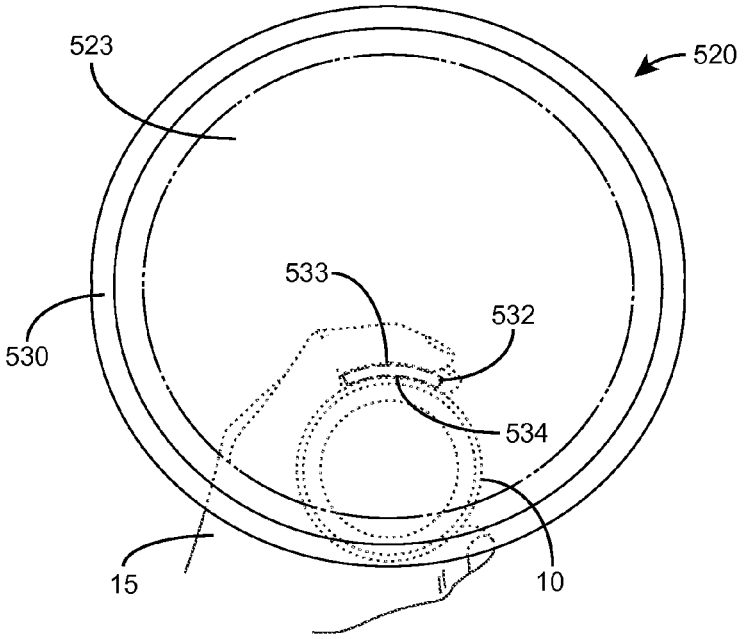
FIG. 39 is a top view of an embodiment in which an incurvate portion is not formed as part of the periphery of the plate.
Figure 40:
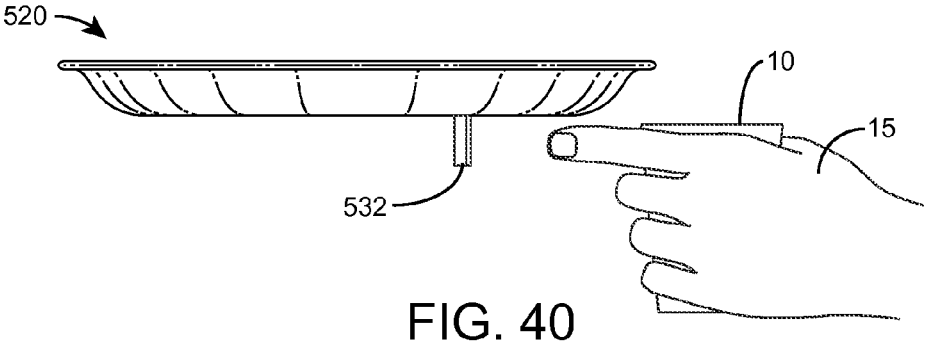
FIG. 40 is a side view of the plate of FIG. 39.
Figure 41:
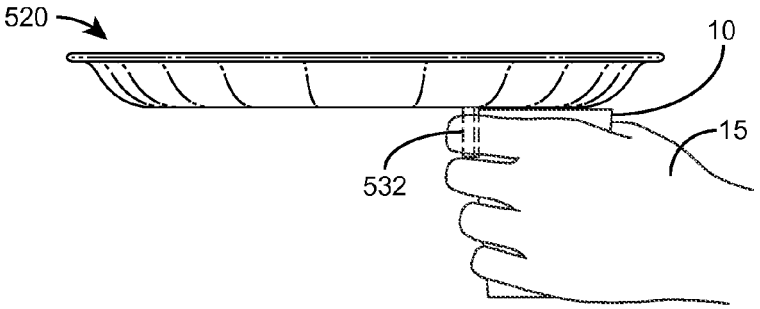
FIG. 41 is a side view of the plate of FIG. 39 shown next to a drinking cup, as the plate might be used.

Further, FIGS. 39-41 show an embodiment in which an incurvate portion 532 is not formed as part of the periphery 530 of the plate 520, but rather is formed on the bottom side of the plate 520. As exhibited in these FIGS. 39-41, the precise location of an incurvate portion may vary, and in certain aspects may be formed on or from any portion of a plate (e.g., the top, bottom, periphery, non-periphery, and the like). Placement of an incurvate portion 532 on the bottom side of the plate may enable the plate to rest on top of the drinking cup 10, providing additional support to the plate when held in one hand, along with the drinking cup. In FIG. 39, the incurvate portion 532 extends away from the food-receiving surface 523, and comprises a first side 533 and a second side 534. The second side 534 may be structured and dimensioned so that the plate 520 may be held in one hand of a user 15 together with a drinking cup 10, wherein when in use the user places a finger along the first side 533, and the second side 534 and the drinking cup 10 are pressed together along a surface of second side 534. FIGS. 40 and 41 show side views of the plate 520, with FIG. 41 showing how the plate might be used. The precise height of the incurvate portion 532 may be about 0.1 to 12.5 cm or more. For example, the height of the incurvate portion 532 may be at least 0.5 cm or more, about 1 cm or more, about 2 cm or more, about 3 cm or more, about 4 cm or more, about 5 cm or more, about 6 cm or more, about 7 cm or more, about 8 cm or more, about 9 cm or more, about 10 cm or more, about 11 cm or more, about 12 cm or more, or about 12.5 cm or more. The precise height, width, and other dimensions of the incurvate portion 532 may be readily determined by one of skill in the art such that the incurvate portion 532 on the bottom side of the plate may enable the plate to rest on top of the drinking cup 10, providing additional support to the plate when held in one hand, along with the drinking cup. Moreover, the incurvate portion 532 may or may not be permanently fixed to the plate. For instance, in certain aspects, the incurvate portion 532 may be a separate piece that may be affixed to the plate via adhesive, press-fit, snap-fit, and the like. Further, in certain embodiments the incurvate portion 532 may be part of the plate, but may need to be moved into the position depicted in FIGS. 39-41. For example, the incurvate portion 532 may be attached using a hinge or an equivalent, wherein the incurvate portion 532 may be flush or nearly flush with the bottom of the plate, and adjusted into the position depicted in FIGS. 39-41 when in use. Accordingly, in certain instances the plates 520 may be stacked when the incurvate portion 532 is in the 'up' (i.e., flush or nearly flush) position. The incurvate portion 532 may be attached, affixed, and/or hinged to the plate 520 by any convenient means.

Figure 27:
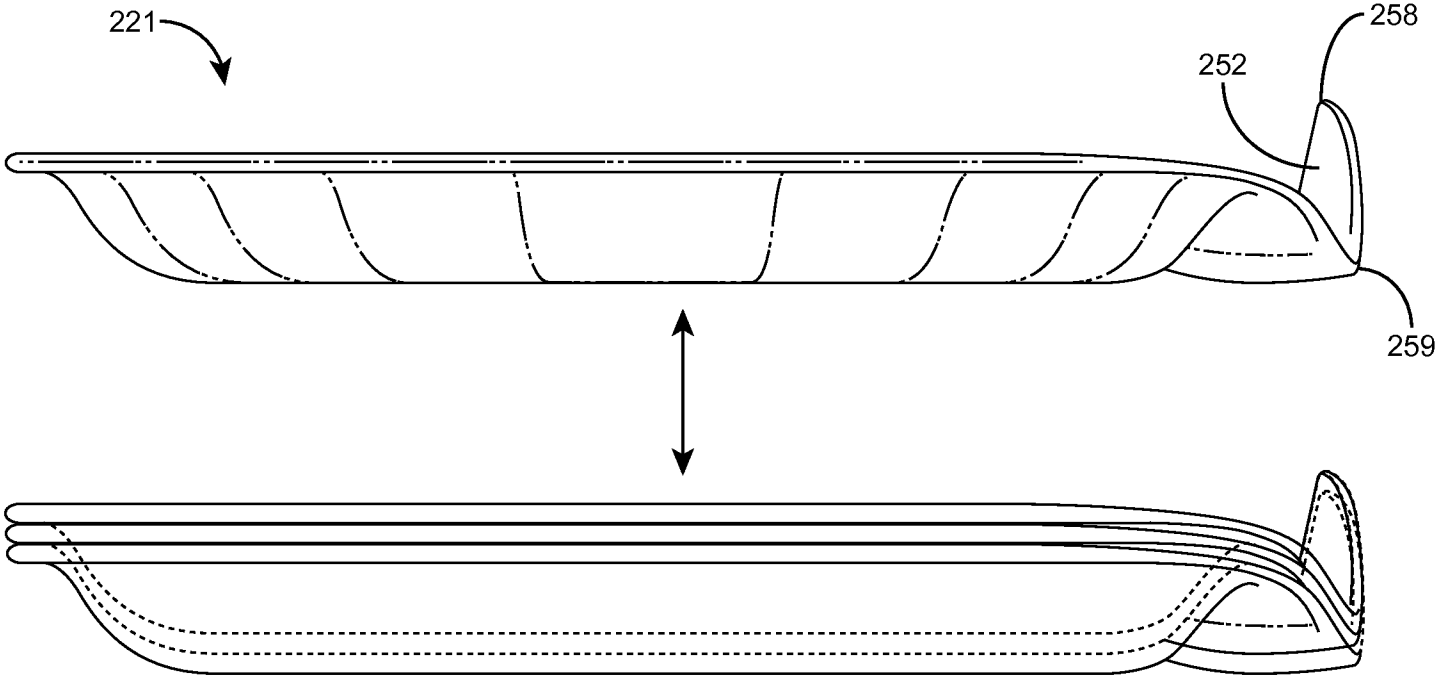
FIG. 27 is a side view of a stack of plates, like the plate shown in FIG. 19.
Figure 28:
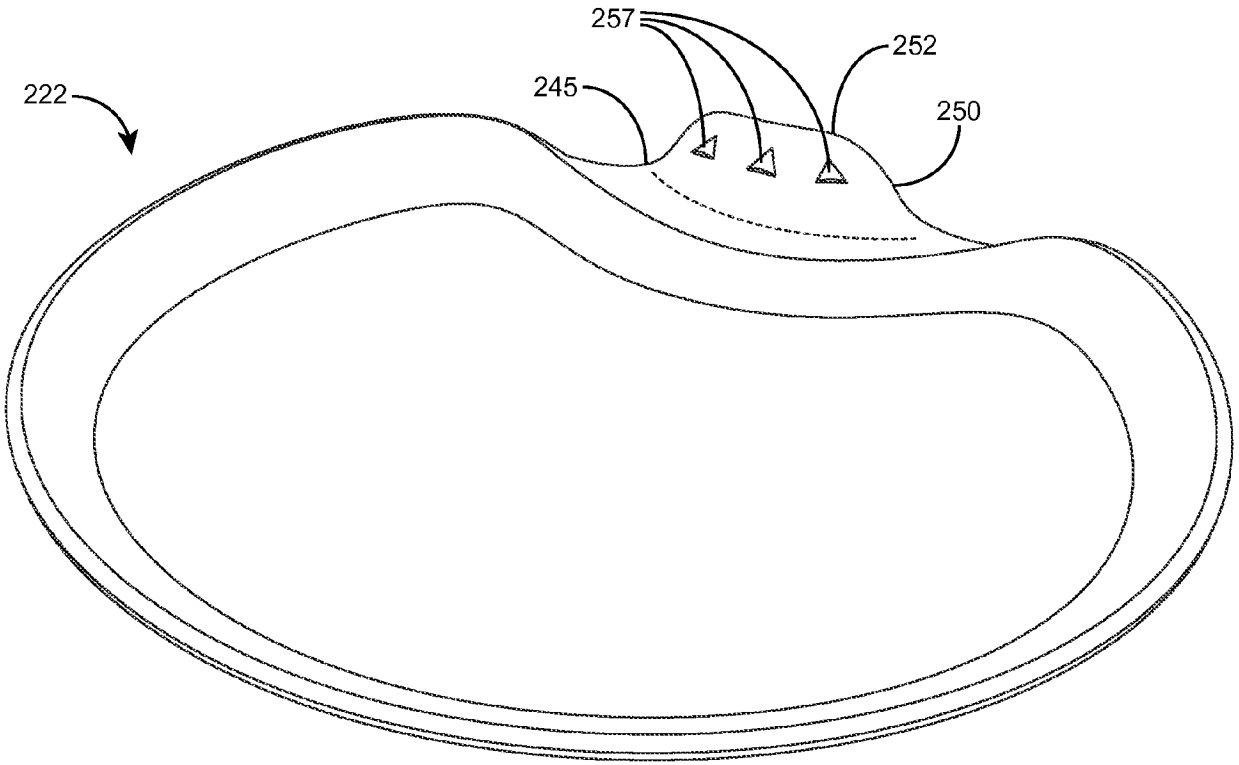
FIG. 28 is a perspective view of one embodiment of the plate.

As is shown in FIGS. 5, 27, 30, and 32, in some aspects the dimensions of the plates are such that the plates may be conveniently stacked atop one another. For example, a plate of the general type depicted in FIGS. 15-24 may be dimensioned, using skill of one in the art, such that a second plate may be placed atop a first plate, and a third plate may be placed below the first plate, such that the plates may be stacked. FIGS. 27-32 depict certain such embodiments, which are variants of the plate 220 shown in FIGS. 19-26. In these figures, the dimensions of each of the plates are such as to allow a second plate having substantially the same dimensions to stack on top of or below the plate. In FIG. 27, the dimensions of first plate 221 are such as to allow a second plate having substantially the same dimensions to stack on top of or below the plate. The raised edge 252 of the outer side may be thought to include a top 258 and bottom 259, such that the top 258 leans away from the center of the plate 221, relative to the bottom 259. That is, in certain instances the raised edge 252 leans outward from the center of the plate 221, permitting a plurality of plates 221 to be stacked. Turning to FIG. 28, the plate 222 again comprises a raised edge 252 of the outer side 250, which may, in certain embodiments, lean away from the center of the plate 222 as it rises. Further, plate 222 includes one or more notches 257 in the raised edge 252. One or more notches 257 may be added by any convenient means, such as stamping. The notches 257 may provide additional grip, such that a user can more easily hold the plate and a drinking cup together in one hand. Though not depicted, the plate 222 may be stacked.

Figure 29:
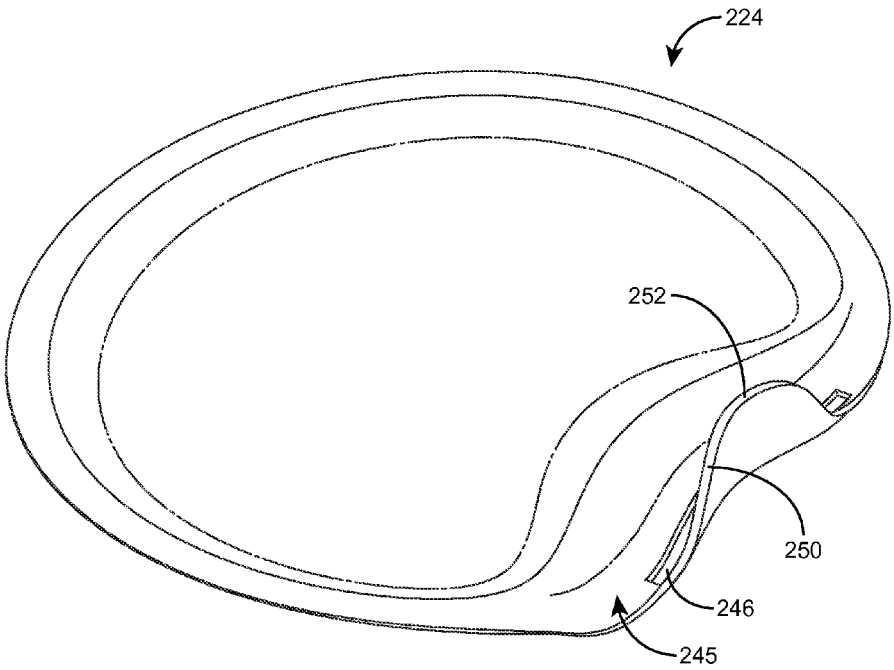
FIG. 29 is a perspective view of one embodiment of the plate.
Figure 30:
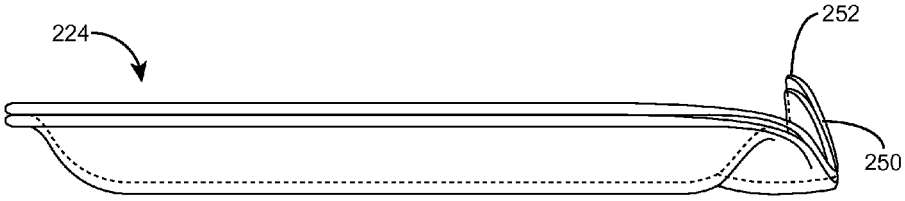
FIG. 30 is side view of a stack of plates, like the plate shown in FIG. 29.
Figure 31:
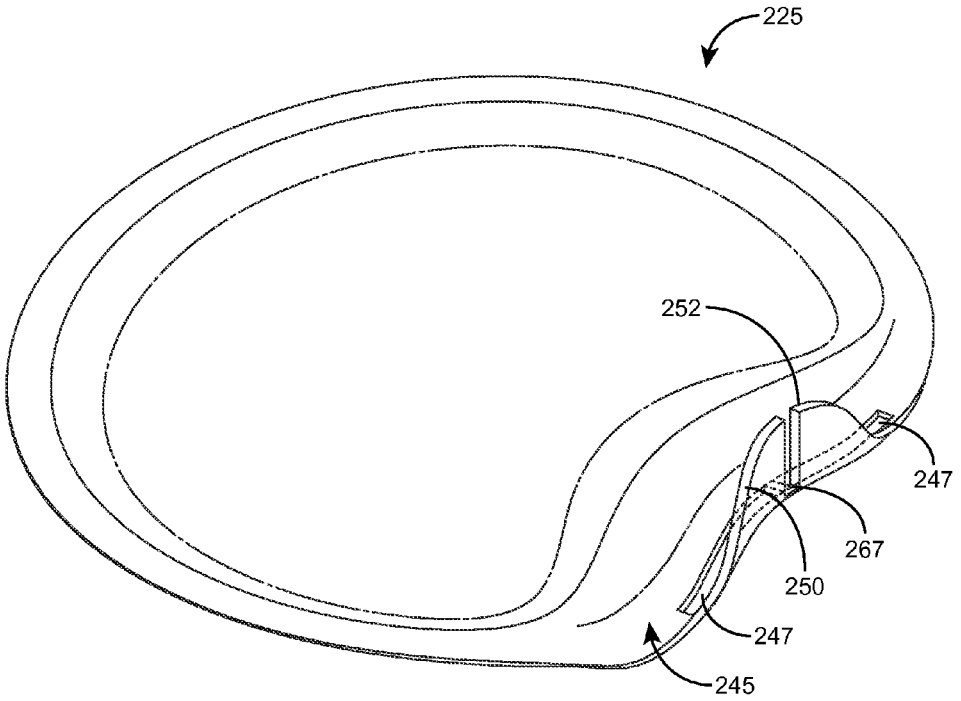
FIG. 31 is a perspective view of one embodiment of the plate.
Figure 32:
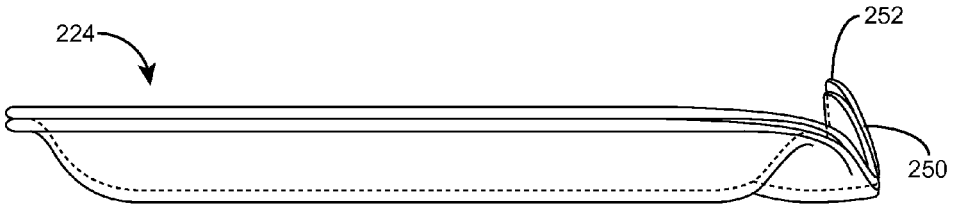
FIG. 32 is side view of a stack of plates like the plate shown in FIG. 31.

In FIG. 29, the raised edge 252 is angled slightly, such that the top portion of the raised edge 252 is closer to the center of the plate 224 than is the bottom portion of the raised edge 252. To permit stacking of a plurality of plates, a slot 246 is contained in the groove 245. The raised edge 252 of a first plate can be passed through this slot 246 of a second plate, such that the first and second plates interlock when stacked, providing increased structural support. A side view of a stack of such plates 224 is presented in FIG. 30. A variant of the embodiment presented in FIGS. 29-30 is presented in FIGS. 31-32. In FIG. 31, the plate 225 includes a raised edge 252 that contains a cutout 267 that corresponds to a bridge formed by a plurality of slots 247 that are is contained in the groove 245. The raised edge 252 of a first plate can be passed through these slots 247 of a second plate, such that the first and second plates interlock when stacked, with the bridge of the first plate sliding into the portion of the groove 245 that is not cut away by the plurality of slots 247 of the second plate, providing increased structural support. FIG. 32 shows a side view of a stack of plates 225.

Various features of different examples are disclosed and may be interchanged and used in different examples than the examples with which they were discussed. Numerous modifications and variations can be effectuated without departing from the true spirit and scope of the novel concepts of the present invention. It is to be understood that no limitation with respect to the specific embodiments illustrated or described is intended or should be inferred.

That which is claimed is:

1. A method of simultaneously singlehandedly holding a plate and a drinking cup, the method comprising:

placing a first finger along a first surface of an incurvate edge of a plate and in a groove extending between a raised outer edge and a raised inner edge, wherein the plate comprises a food receiving surface comprising a top side, and wherein the groove is on a same side of the plate as the top side and is separated from the food receiving surface by the raised inner edge, mating the drinking cup along a second surface of the incurvate edge of the plate, and wrapping a second finger along the drinking cup to simultaneously singlehandedly hold the plate and the drinking cup, wherein the drinking cup rests only on the second surface of the incurvate edge of the plate.

2. The method according to claim 1, comprising placing the first finger in a groove of the plate.

3. The method according to claim 2, comprising placing a third finger in the groove.

4. The method according to claim 1, comprising placing a third finger along the first surface of the incurvate edge of the plate.

5. The method according to claim 1, wherein the first finger is a user's index finger.

6. The method according to claim 5 wherein the second finger is the user's thumb.

7. The method according to claim 1, wherein the second finger is a user's thumb.

8. The method according to claim 1, comprising placing the first finger through a support structure of the plate.

9. The method according to claim 1, wherein the incurvate edge corresponds generally with an arc that extends no more than about 180°.

10. The method according to claim 1, wherein the food-receiving surface comprises a bottom side; and wherein the incurvate edge is attached to the bottom side of the food receiving surface and extending away from the food-receiving surface.

11. A method of simultaneously singlehandedly holding a plurality of plates and a drinking cup, the method comprising:

placing a first finger along first surfaces of incurvate edges of at least first and second plates and in a groove of each plate extending between a raised outer edge and a raised inner edge of each plate, wherein the first and second plates each comprise a food receiving surface comprising a top side, and wherein the groove of each plate is on a same side of the plate as the top side and is separated from the food receiving surface by the raised inner edge, mating the drinking cup along second surfaces of the incurvate edges of the at least first and second plates, and wrapping a second finger along the drinking cup to simultaneously singlehandedly hold the at least first and second plates and the drinking cup, wherein the drinking cup rests only on the second surfaces of the incurvate edges of the at least first and second plates.

12. The method according to claim 11, wherein the first finger is a user's index finger.

13. The method according to claim 12, wherein the second finger is the user's thumb.

14. The method according to claim 11, comprising placing the first finger through a support structure of the plate.

15. The method according to claim 11, wherein the incurvate edge corresponds generally with an arc that extends no more than about 180°.

16. The method according to claim 11, comprising placing the first finger in grooves of the first and second plates.

17. The method according to claim 16, comprising placing a third finger in the groove.

18. The method according to claim 1, wherein the groove comprises a surface extending below the raised inner edge and the raised outer edge.

19. The method according to claim 1, wherein the groove comprises a surface at a same lateral level as the food receiving surface.

20. The method according to claim 1, wherein the groove comprises a first sidewall extending from the raised outer edge, a second sidewall opposite the first sidewall and extending from the raised inner edge, and a bottom connecting portion extending between the first and second sidewall.

* * * * *